US011228095B2

(12) United States Patent
Zhu

(10) Patent No.: US 11,228,095 B2
(45) Date of Patent: Jan. 18, 2022

(54) WEARABLE DEVICES WITH ANTENNAS PLATED ON HIGH PERMITTIVITY HOUSING MATERIALS

(71) Applicant: Google LLC, Mountain View, CA (US)

(72) Inventor: Jiang Zhu, Cupertino, CA (US)

(73) Assignee: Google LLC, Mountain View, CA (US)

( * ) Notice: Subject to any disclaimer, the term of this patent is extended or adjusted under 35 U.S.C. 154(b) by 162 days.

(21) Appl. No.: 16/023,067

(22) Filed: Jun. 29, 2018

(65) Prior Publication Data

US 2020/0006842 A1 Jan. 2, 2020

(51) Int. Cl.

| | |
|---|---|
| ***H01Q 1/24*** | (2006.01) |
| ***H01Q 1/27*** | (2006.01) |
| ***H01Q 5/30*** | (2015.01) |
| ***H01Q 1/22*** | (2006.01) |

(Continued)

(52) U.S. Cl.

CPC ..... *H01Q 1/273* (2013.01); *H01Q 1/2266* (2013.01); *H01Q 1/241* (2013.01); *H01Q 1/42* (2013.01); *H01Q 1/48* (2013.01); *H01Q 5/30* (2015.01)

(58) Field of Classification Search

CPC ..... H01Q 1/273; H01Q 1/48; H01Q 1/42; H01Q 1/241; H01Q 1/2266; H01Q 5/30; H01Q 5/378; H01Q 5/335; H01Q 5/328; H01Q 5/321

See application file for complete search history.

(56) References Cited

U.S. PATENT DOCUMENTS 7,616,158 B2 * 11/2009 Mak ..... H01Q 1/243 343/700 MS
2008/0316115 A1 * 12/2008 Hill ..... H01Q 1/243 343/702

(Continued)

FOREIGN PATENT DOCUMENTS

CN 107645060 A 1/2018
EP 2683027 A1 1/2014

OTHER PUBLICATIONS

International Search Report and Written Opinion for International Application No. PCT/US2019/035509 dated Aug. 19, 2019. 15 pages.

(Continued)

*Primary Examiner* — Dameon E Levi
*Assistant Examiner* — David E Lotter
(74) *Attorney, Agent, or Firm* — Lerner, David, Littenberg, Krumholz & Mentlik, LLP

(57) ABSTRACT

An antenna is provided for a wearable personal computing device, such as a smartwatch. The antenna has a first radiating element and a second radiating element capacitively coupled to each other. The first radiating element is configured to be tunable to a first set of tuning states operating around a first set of resonant frequencies, and the second radiating element is configured to be tunable to a second set of tuning states operating around a second set of resonant frequencies. The antenna is configured to be tuned such that a tuning state from the first set of tuning states of the first radiating element can be combined with a tuning state from the second set of tuning states of the second radiating element to form a composite tuning state of the antenna. The wearable personal computing device has a housing made of a high permittivity material.

20 Claims, 16 Drawing Sheets

(51) Int. Cl.
*H01Q 1/42* (2006.01)
*H01Q 1/48* (2006.01)

(56) References Cited

U.S. PATENT DOCUMENTS

| | | | | |
|---|---|---|---|---|
| 2014/0145892 | A1* | 5/2014 | Tseng | H01Q 1/38 343/750 |
| 2014/0187178 | A1 | 7/2014 | Yang et al. | |
| 2015/0091766 | A1 | 4/2015 | Ali et al. | |
| 2015/0222020 | A1 | 8/2015 | Tai et al. | |
| 2016/0254587 | A1* | 9/2016 | Jung | H04B 5/0037 343/702 |
| 2018/0151947 | A1* | 5/2018 | Apostolos | H01Q 21/28 |
| 2018/0287246 | A1* | 10/2018 | Kim | H01Q 1/243 |

OTHER PUBLICATIONS

International Preliminary Report on Patentability for International Application No. PCT/US2019/035509 dated Jan. 7, 2021. 9 pages.

* cited by examiner

Mismatch loss at band edge: > 15 dB

Mismatch loss at band edge: about 1dB

WEARABLE DEVICES WITH ANTENNAS PLATED ON HIGH PERMITTIVITY HOUSING MATERIALS

BACKGROUND

Portable electronic devices include one or more antennas for transmitting and receiving signals in various communication bands. Antenna design for small electronic devices, such as wearable devices, can be very challenging because of the constrained form factors of such devices. For example, while a smart phone may have limited space for housing its antennas, a smartwatch with a compact form factor would necessarily have even less space. The limited space often impacts antenna performance, which may be measured by radiation efficiency and bandwidth. Further, antenna performance for wearable devices may be severely impacted by body effects due to the close proximity to the wearer, which may cause detuning, attenuation, and shadowing of the antenna. While coverage of WiFi and GPS signals may require covering only two communication bands, coverage of LTE signals may require covering many communication bands, such as various communication bands within the low-band LTE frequency range between 700 MHz and 960 MHz, mid-band LTE frequency range between 1710 MHz to 2200 MHz, and high-band LTE frequency range between 2500 MHz and 2700 MHz.

BRIEF SUMMARY

The present disclosure provides for an antenna for a personal computing device, the antenna comprising a first radiating element configured to be tunable to a first set of tuning states operating around a first set of resonant frequencies; a second radiating element capacitively coupled to the first radiating element, the second radiating element configured to be tunable to a second set of tuning states operating around a second set of resonant frequencies; wherein the antenna is configured to be tuned such that a tuning state from the first set of tuning states of the first radiating element can be combined with a tuning state from the second set of tuning states of the second radiating element to form a composite tuning state of the antenna.

The antenna may further comprise a loading capacitor capacitively coupling the first radiating element and the second radiating element.

The antenna may further comprise an impedance tuner positioned at a feed of the antenna, the impedance tuner configured to tune the first radiating element.

The antenna may further comprise an aperture tuner connecting the second radiating element to a ground plane, the aperture tuner configured to tune the second radiating element. The aperture tuner may be a loading inductor.

The antenna may further comprise a third radiating element coupled to the first radiating element, the third radiating element configured to be tunable to a third set of tuning states operating around a third set of resonant frequencies.

A clearance between the antenna and a ground plane may be within a threshold of 1 mm.

The one or more resonant frequencies from the first set of resonant frequencies and one or more resonant frequencies from the second set of resonant frequencies may be in frequency ranges between 700 MHz and 960 MHz for LTE signals. The one or more resonant frequencies from the third set of resonant frequencies may be in frequency ranges between 1710 MHz and 2200 MHz for LTE signals. One or more harmonics of the resonant frequencies from the first set of resonant frequencies or one or more harmonics of the resonant frequencies from the second set of resonant frequencies are in at least one of frequency ranges between 1710 MHz and 2200 MHz for LTE signals or frequency ranges between 2500 MHz and 2700 MHz for LTE signals.

The first radiating element and the second radiating element may be conductive material plated on a dielectric material.

The present disclosure further provides for a personal computing device, comprising a housing, the housing made of a dielectric material; a first antenna, the first antenna comprising a first radiating element configured to be tunable to a first set of tuning states operating around a first set of resonant frequencies, a second radiating element capacitively coupled to the first radiating element, the second radiating element configured to be tunable to a second set of tuning states operating around a second set of resonant frequencies, wherein the first antenna is configured to be tuned such that a tuning state from the first set of tuning states of the first radiating element can be combined with a tuning state from the second set of tuning states of the second radiating element to form a composite tuning state of the first antenna, and wherein the first radiating element and the second radiating element include conductive material plated on one or more inside surfaces of the housing.

The device may further comprise a second antenna, the second antenna comprising a fourth radiating element configured to be tunable to a fourth set of tuning states operating around a fourth set of resonant frequencies, wherein one or more resonant frequencies from the fourth set of resonant frequencies are in frequency ranges centered at 1575.42 MHz for GPS signals, or between 2400 MHz and 2484 MHz for WiFi signals; wherein the fourth radiating element include a conductive material plated on the one or more inside surfaces of the housing.

The first antenna of the device may further comprise a loading capacitor for capacitively coupling the first radiating element and the second radiating element, wherein the loading capacitor is plated on the one or more inside surfaces of the housing.

The first antenna of the device may further comprise an impedance tuner positioned at a feed of the first antenna configured to tune the first radiating element, wherein the impedance tuner is plated on the one or more inside surfaces of the housing.

The first antenna of the device may further comprise an aperture tuner connecting the second radiating element to a ground plane, wherein the aperture tuner is plated on the one or more inside surfaces of the housing.

The first antenna of the device may further comprise a third radiating element coupled to the first radiating element, the third radiating element configured to be tunable to a third set of tuning states operating around a third set of resonant frequencies; wherein the third radiating element include a conductive material plated on the one or more inside surfaces of the housing.

A clearance between the antenna system and a ground plane may be within a threshold of 1 mm.

The device may be a wearable personal computing device.

The dielectric material may be a glass or a ceramic material.

DETAILED DESCRIPTION

Overview

Figure 1A:
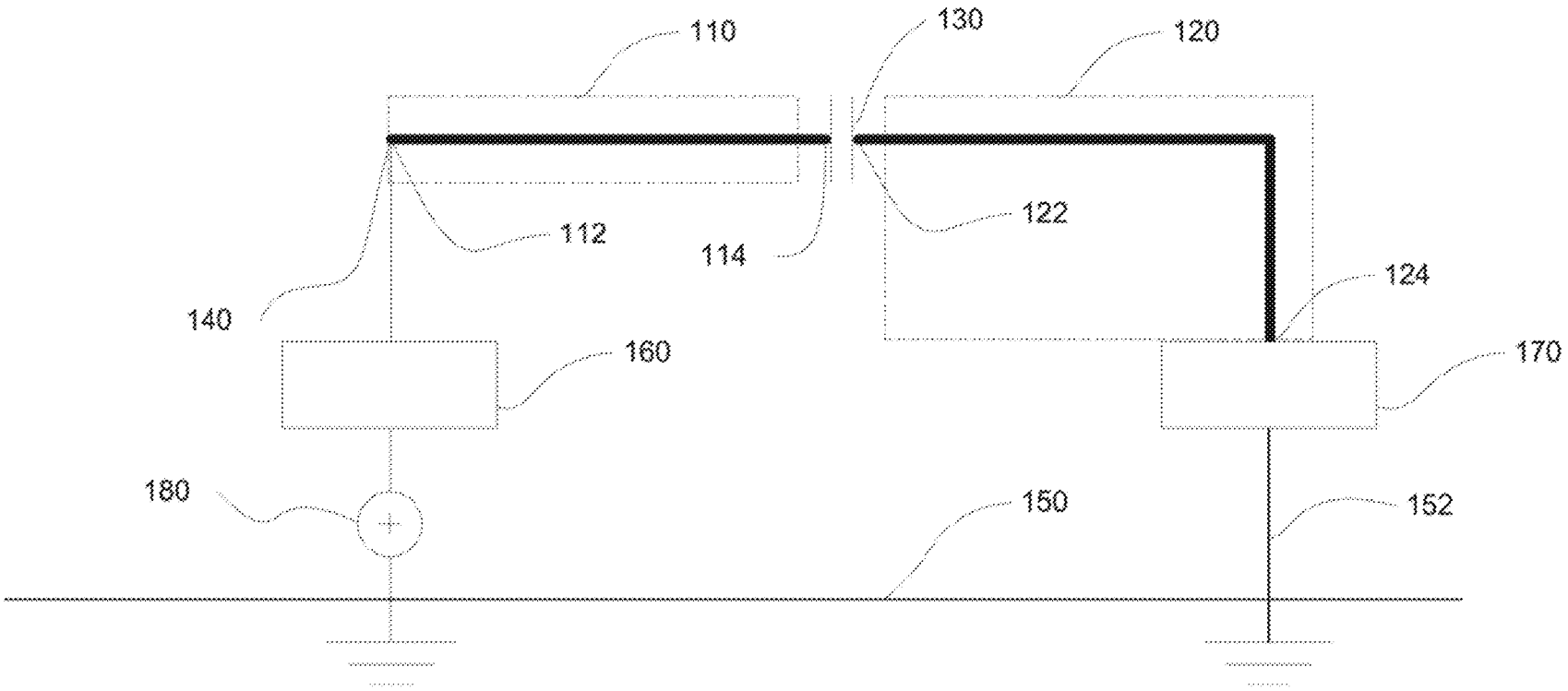
FIG. 1A is a simplified circuit diagram of an example antenna according to aspects of the disclosure.

The technology generally relates to an antenna for a personal computing device. High permittivity materials such as glass or ceramic are often used as housing for personal computing devices due to their mechanical durability and aesthetic features. Such materials provide a high dielectric loading to antennas placed therein. For example, one manufacturing process involves plating antenna radiating elements directly onto an interior surface of a ceramic or glass housing. This means that the antennas placed inside such materials can achieve the same electrical length with a reduced physical size, but the reduced size also means that the antennas would have narrower bandwidths. Further, due to manufacturing tolerances, air gaps may be formed between the housing and the antennas inside. For example, another manufacturing process involves plating antenna radiating elements on a surface of a plastic component, where the plastic component is joined (such as by insert-molding) onto an interior surface of the ceramic or glass housing. Because the dielectric constant for air is much smaller than the dielectric constant for glass/ceramic, an air gap as small as 0.1 mm may cause a large frequency shift (for example 200 MHz) for the antennas, causing instability.

For small electronic devices, such as a smartwatch, antenna design may be especially challenging because of the small form factors of such devices. For instance, because of limited space in a smartwatch, the size of the antenna ground plane may be smaller or comparable to a quarter wavelength of the signals that the antenna is designed to receive/transmit. This means that the ground plane would be strongly excited and become part of the radiating element of the antenna. For example, for a smartwatch the size of the ground plane is limited by the dimensions of the smartwatch, such as 40 mm (length, width, or diameter of the watch). However, the free space wavelength of low-band LTE signals at 750 MHz is 400 mm. Thus, the size of the ground plane at 40 mm is less than 100 mm (the quarter wavelength of these 750 MHz signals). For another example, even at the high end of mid-band LTE frequencies such as 2200 MHz, where the free wavelength is about 136 mm, the quarter wavelength at this frequency, 34 mm, is still comparable to the 40 mm ground plane.

In addition, the clearance between the antenna and the ground plane within the smartwatch form factor may also be very small, for example around 1 mm, which can also negatively affect antenna performance. Furthermore, when multiple antennas are employed in a wearable device for receiving/transmitting at different frequency ranges (such as WiFi/GPS, LTE), the small clearance may cause unwanted coupling between the various antennas. The small form factor also limits the space available for including tuners for the antennas, which may be necessary in order to achieve coverage of many communication bands is required, for example, bands required by major LTE carriers may include LTE bands B5, B8, B12, B13, and B17 in the low-band LTE ranges, LTE bands B2 and B4 in the mid-band LTE ranges, and LTE bands B40, B41, and B7 of the high-band LTE ranges. To provide coverage of many communication bands, one or more tuners may be provided to tune the antenna between various resonance frequencies and to reduce mismatch.

Also, due to the close proximity to a portion of the wearer's body, antenna performance for a wearable device may be severely impacted by body effects, which may cause detuning, attenuation, and shadowing of the antenna.

In this regard, one example antenna has a first radiating element and a second radiating element capacitively coupled to each other. The first radiating element is configured to be tunable to a first set of tuning states operating around a first set of resonant frequencies, and the second radiating element is configured to be tunable to a second set of tuning states operating around a second set of resonant frequencies. The antenna is configured to be tuned such that a tuning state from the first set of tuning states of the first radiating element can be combined with a tuning state from the second set of tuning states of the second radiating element to form a composite tuning state of the antenna. To select or tune between the various tuning states, the antenna includes one or more tuners. Since the composite tuning state is a combination of two tuning states from the two radiating elements, it has a wider bandwidth. Using these composite tuning states, the antenna can provide wide bandwidths stably even when housed inside high permittivity materials. For example, the first set of resonant frequencies and the second set of resonant frequencies may be in frequency ranges between 700 MHz and 960 MHz to provide coverage of low-band LTE communication bands. As such, the antenna may be implemented as an LTE antenna in any of a number of devices, such as smart watches, smart phones, tablets, etc.

The one or more tuners may include an impedance tuner and/or an aperture tuner. For example, an impedance tuner may be configured to select a tuning state for the first radiating element. For instance, the impedance tuner may be implemented as a variable capacitor positioned at an antenna feed. For another example, an aperture tuner may be configured to select a tuning state for the second radiating element. For instance, the aperture tuner may be implemented as a loading inductor connecting the second radiating element to a ground plane.

In another example, the antenna may further include a third radiating element. The third radiating element is configured to be tunable to a third set of tuning states operating around a third set of resonant frequencies. For example, when implemented as an LTE antenna, the third set of resonant frequencies may be in frequency ranges between 1710 MHz to 2200 MHz and between 2500 MHz and 2700 MHz to provide coverage of, respectively, mid-band and high-band LTE communication bands. This way, the antenna may provide greater diversity in coverage of LTE communication bands.

In another aspect, an antenna system is provided with two antennas. For example, the antenna system includes a first antenna having at least two radiating elements as described above, and a second antenna having a fourth radiating element configured to be tunable to a fourth set of tuning states operating around a fourth set of resonant frequencies. For instance, the fourth set of resonant frequencies may be in frequency ranges centered at 1575.42 MHz for GPS signals, or between 2400 MHz and 2484 MHz for WiFi signal. As such, the antenna system may provide coverage of LTE communication bands via the first antenna, and coverage of GPS/WiFi communication bands via the second antenna.

In still another aspect, a wearable device is provided with an antenna system having one or more antennas. For example, the wearable device may include the antenna system with the two antennas as described above. The wearable device includes a front cover of a display device configured to present information to the wearer of the wearable electronic device. A housing made of a high permittivity material is attached to the cover for supporting various mechanical and/or electronic components, including the antenna system. A ground plane for the antenna system may be formed by a metallic component of the wearable personal computing device, such as a circuit board with a shielding can. A back cover is attached to the housing to provide insulation between the various electronic components and the wearer's skin or clothing. Optionally, a glass or other non-conductive back plate is attached to the back cover to provide further insulation between the various electronic components and the wearer's skin or clothing.

The antenna and antenna systems as described above provide for efficient operation of devices, particularly for small factor wearable electronic devices with high permittivity housings. Features of the antenna provide for forming composite tuning states having wider bandwidths by coupling the tuning states of two radiating elements. The wider bandwidths provide a multitude of practical advantages. For instance, higher antenna bandwidth increases throughput, improves link budget (gains and losses from a transmitter to receiver), and increases battery life as less power is needed for the antenna. Further, many commercial carriers set requirements for devices that are allowed to use their network, such as Total Radiated Power (TRP) and Total Isotropic Sensitivity (TIS). Insufficient antenna bandwidth may cause the devices to fail these requirements, and consequently not able to use these commercial networks. Features of the antenna system also provide for reduced interference from other components in the wearable electronic device, reduced coupling with other antennas, and greater isolation from the body effects of the user.

Example Systems

FIG. 1A shows a simplified circuit diagram of an example antenna 100A according to aspects of the disclosure. The antenna 100A may be any type of antenna, for example, a monopole antenna, a dipole antenna, a planar antenna, a slot antenna, a hybrid antenna, a loop antenna, an inverted-F antenna, etc. The antenna 100A includes multiple radiating elements. The radiating elements may be made of any of a number of conductive materials, such as metals and alloys. For example, as shown, the antenna 100A includes a first radiating element 110 and a second radiating element 120. The first radiating element 110 has a first end 112 and a second end 114. The second radiating element 120 also has a first end 122 and a second end 124. The first and second radiating elements 110 and 120 are configured to support the currents or fields that contribute directly to the radiation patterns of the antenna 100A. For example, the first radiating element 110 may be configured to be tunable to a first set of tuning states operating around a first set of resonant frequencies, and the second radiating element 120 may be configured to be tunable to a second set of tuning states operating around a second set of resonant frequencies. The first set of resonant frequencies may be different from the second set of resonant frequencies.

The first set of tuning states for the first radiating element 110 and the second set of tuning states for the second radiating element 120 may cover a first set of frequency ranges. For example, the first set of frequency ranges includes communication bands in the low-band LTE frequency ranges, such as LTE bands between 700 MHz and 960 MHz (for example as shown in FIGS. 2B and 2D). When the first and second radiating elements 110, 120 are configured to cover such a large number of communication bands, adequate antenna bandwidths are critical in ensuring coverage.

In another example, the first set of tuning states for the first radiating element 110 and the second set of tuning states for the second radiating element 120 may additionally cover a second set of frequencies. In this regard, one or more tuning states from the first set of tuning states may include harmonics of the resonant frequencies from the first set of resonant frequencies. Similarly, one or more tuning states from the second set of tuning states may also include harmonics of the resonant frequencies from the second set of resonant frequencies. For instance, such harmonics may be in frequency ranges between 1710 MHz and 2200 MHz for mid-band LTE signals, and/or between 2500 MHz and 2700 MHz for high-band LTE signals.

The first and second radiating elements 110, 120 are capacitively coupled, for example, through a loading capacitor 130. As shown, the loading capacitor 130 is positioned between the second end 114 of the first radiating element 110 and the first end 122 of the second radiating element 120. For example, the loading capacitor 130 may be a parallel-plates capacitor, and the gap between the parallel plates may be chosen to allow a desirable amount of coupling between the two radiating elements 110, 120. For another example, the loading capacitor 130 may be an interdigtal capacitor whose dimensions are chosen to allow a desirable amount of coupling between the two radiating elements 110, 120. The loading capacitor 130 may be selected such that it enables tuning states of the first radiating element 110 to be merged with tuning states from the second radiating element 120 to form one or more composite tuning states. In other words, each composite tuning state may be considered a "dual-resonance" tuning state—a superimposition of two tuning states operating around their respective resonant frequencies ("single-resonance" tuning states). This way, each composite tuning state may have a greater bandwidth to cover a desired frequency range than the respective tuning states from the first set of tuning states and the second set of tuning states (for example, compare widths of the curves shown in FIG. 2A with those in FIG. 2B).

The antenna 100A includes one or more antenna feeds. For example, as shown, the antenna 100A includes an antenna feed 140. The antenna feed 140 is positioned at the first end 112 of the first radiating element 110. The antenna feed 140 is configured to feed the currents or fields of radio waves to the rest of the antenna structure, including the first and second radiating elements 110 and 120, or collect the incoming currents or fields of radio waves, convert them to electric currents and pass the currents to one or more receivers. In this regard, the antenna feed 140 may be connected to an antenna control circuit (not shown in FIG. 1A, shown as 758 in FIG. 7). The antenna control circuit (not shown in FIG. 1A, shown as 758 in FIG. 7) may be configured to feed the antenna 100A at the antenna feed 140. In some examples (not shown), the antenna 100A may be capacitively fed by a feed structure positioned proximate to the antenna feed 140. The antenna feed 140 is connected to a conducted port 180, which is in turn connected to one or more transceivers (not shown).

The antenna 100A is connected to a ground plane. For example, referring back to FIG. 1A, the second end 124 of the second radiating element 120 is connected to a ground plane 150. In this regard, an electrical connection 152 may be provided to short the second end 124 of the second radiating element 120 to the ground plane 150. The ground plane 150 is a conducting surface that serves as a reflecting surface for radio waves received and/or transmitted by the radiating elements 110 and 120. In addition, by positioning the electrical connection 152 at the second end 124 of the second radiating element 120, it may also act as one of the antenna openings for the antenna 100A (e.g., boundary conditions where the antenna 100A either begins or ends).

To select the various tuning states, the antenna 100A includes one or more tuners. For example, as shown, the antenna 100A includes an impedance tuner 160 and an aperture tuner 170. The impedance tuner 160 is connected to the antenna 100A to tune the first radiating element 110 to one of the tuning states in the first set of tuning states. The impedance tuner 160 may also be configured to change the impedance of the antenna 100A for better impedance matching with the desired communication band. For example, the impedance tuner 160 may tune the antenna's impedance matching to 50 ohm. As shown, the impedance tuner 160 is implemented at the antenna feed 140, at the first end 112 of the first radiating element 110. Additionally or alternatively, a pre-matching circuit (not shown) may be connected between the antenna feed 140 and the impedance tuner 160 to customize the impedance tuner 160 as needed.

The aperture tuner 170 is connected to the second radiating element 120 to tune the second radiating element 120 to one of the tuning states in the second set of tuning states. In this regard, the aperture tuner 170 changes the aperture size of the second radiating element 120, which affects the resonant frequency of the second radiating element 120. As shown, the aperture tuner 170 is positioned between the second end 124 of the second radiating element 120 and the electrical connection 152. Alternatively, the aperture tuner 170 may be positioned inside the second radiating element 120 such that the aperture tuner 170 is at a location where the current and/or field distribution is relatively stronger than other locations of the second radiating element 120. The aperture tuner 170 may be configured to select a tuning state from the second set of tuning states for the second radiating element 120.

The impedance tuner 160 and aperture tuner 170 may be selected such that, when tuning states from the impedance tuner 160 are combined with tuning states from the aperture tuner 170, the respective resonances can be merged to cover certain LTE low band with extended antenna bandwidth. The impedance tuner 160 and aperture tuner 170 may improve frequency match, antenna efficiency, and reduce specific absorption rate even when the size of the ground plane 150 is comparable to or smaller (e.g., 40 mm) than the quarter wavelengths of the low-band LTE or mid-band LTE signals, and a clearance between the ground plane 150 and the antenna 100A is as small as 1 mm. Although in this example, the impedance tuner 160 is configured primarily to tune the first radiating element 110, the impedance tuner 160 may also have some tuning effects on the second radiating element 120. Likewise, although the aperture tuner 170 in this example is configured primarily to tune the second radiating element 120, the aperture tuner 170 may have some tuning effects on the first radiating element 110. In other words, the cumulative tuning effects of the impedance tuner 160 and the aperture tuner 170 on the two radiating elements 110 and 120 allow composite tuning states to be formed for the antenna 100A, where each such composite tuning state is a superimposition of two tuning states operating about their respective resonant frequencies.

Figure 7:
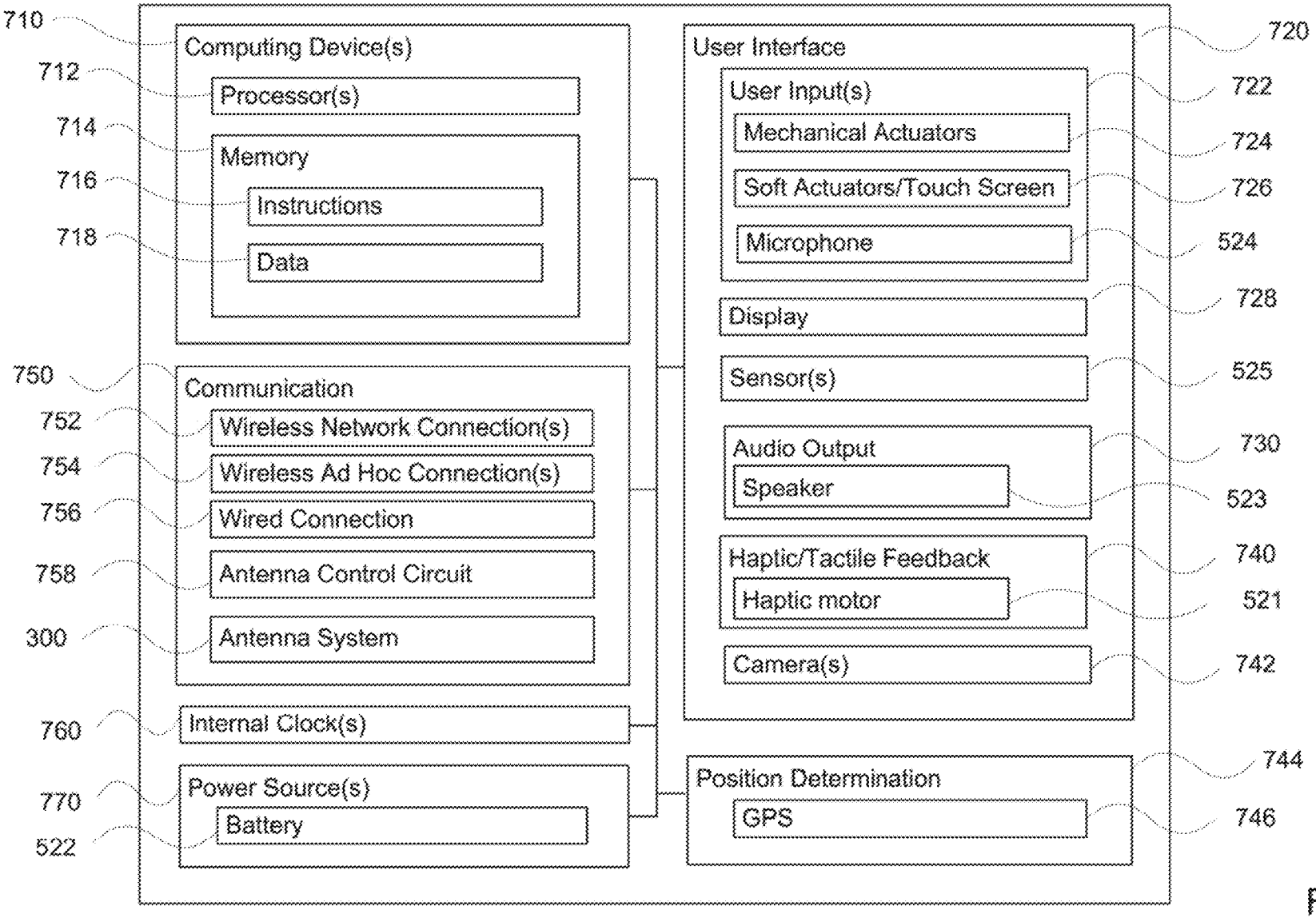
FIG. 7 is a block diagram illustrating an example system in accordance with aspects of the disclosure.

The impedance tuner 160 and the aperture tuner 170 may be active tuners controlled by the antenna control circuit (not shown in FIG. 1A, shown as 758 in FIG. 7). In this regard, the impedance tuner 160 and the aperture tuner 170 may tune between different communication bands based on any of a number of network requirements, such as signal strength and user traffic. For example, the impedance tuner 160 and aperture tuner 170 may be configured such that, when signal strength drops below a low quality threshold for the LTE band that the antenna 100A is currently tuned to, the impedance tuner 160 may change the impedance of the first radiating element 110 to change its resonant frequency (changing tuning state), and the aperture tuner 170 may change the aperture size of the second radiating element 120 to change its resonant frequency (changing tuning state), as a result, the antenna 100A may be tuned to a different composite resonant frequency (changing composite tuning state) to receive and transmit signals at another LTE band around this new resonant frequency. The impedance tuner 160 and aperture tuner 170 may be configured such that, when a switch of resonant frequency is made by the impedance tuner 160, the aperture tuner 170 would adjust accordingly, and vice versa.

Figure 1B:
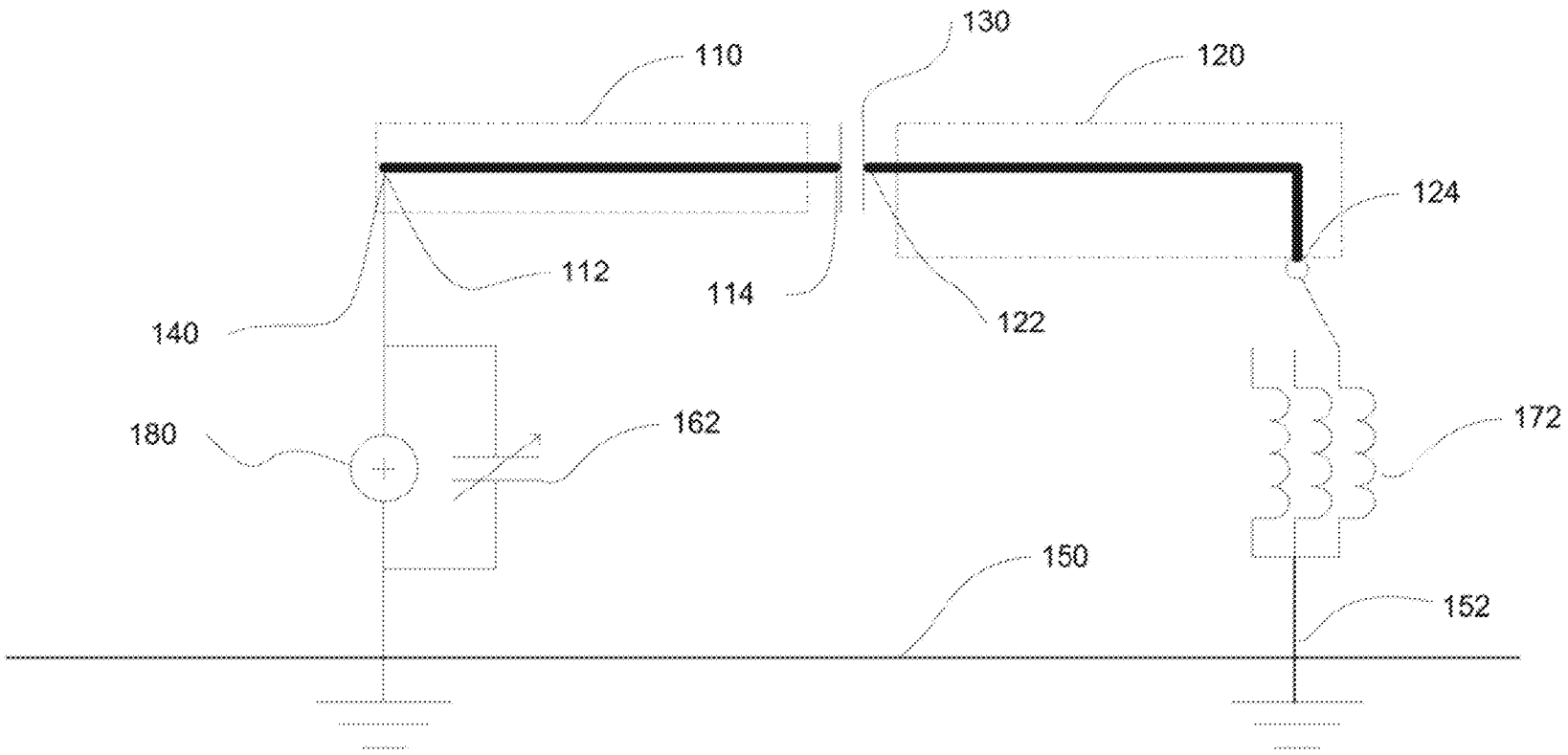
FIG. 1B is a simplified circuit diagram of another example antenna according to aspects of the disclosure.

FIG. 1B is a simplified circuit diagram of another example antenna 100B according to aspects of the disclosure. Example antenna 100B includes many of the features of example antenna 100A, but with certain differences as discussed further below. For instance, the impedance tuner of antenna 100B is implemented as a variable capacitor 162. The variable capacitor 162 may be configured to change its capacitance, and depending on this capacitance, a tuning state from the first set of tuning states may be selected for the first radiating element 110.

For another instance, the aperture tuner of antenna 100B is implemented as a loading inductor 172. For small form factor devices (such as a smart watch), limited space often limit the size of radiating elements to shorter than a desired length, in such cases, loading inductors may be used as aperture tuners. For example, as shown, the loading inductor 172 may include a plurality of inductor elements each having a different inductance, and depending on which inductor element is connected by a switch, a different tuning state from the second set of tuning states may be selected for the second radiating element 120. Conversely, if the second radiating element 120 is too long (for example in a large computing device such as a laptop), then a loading capacitor may be provided instead of the loading inductor 172.

Figure 1C:
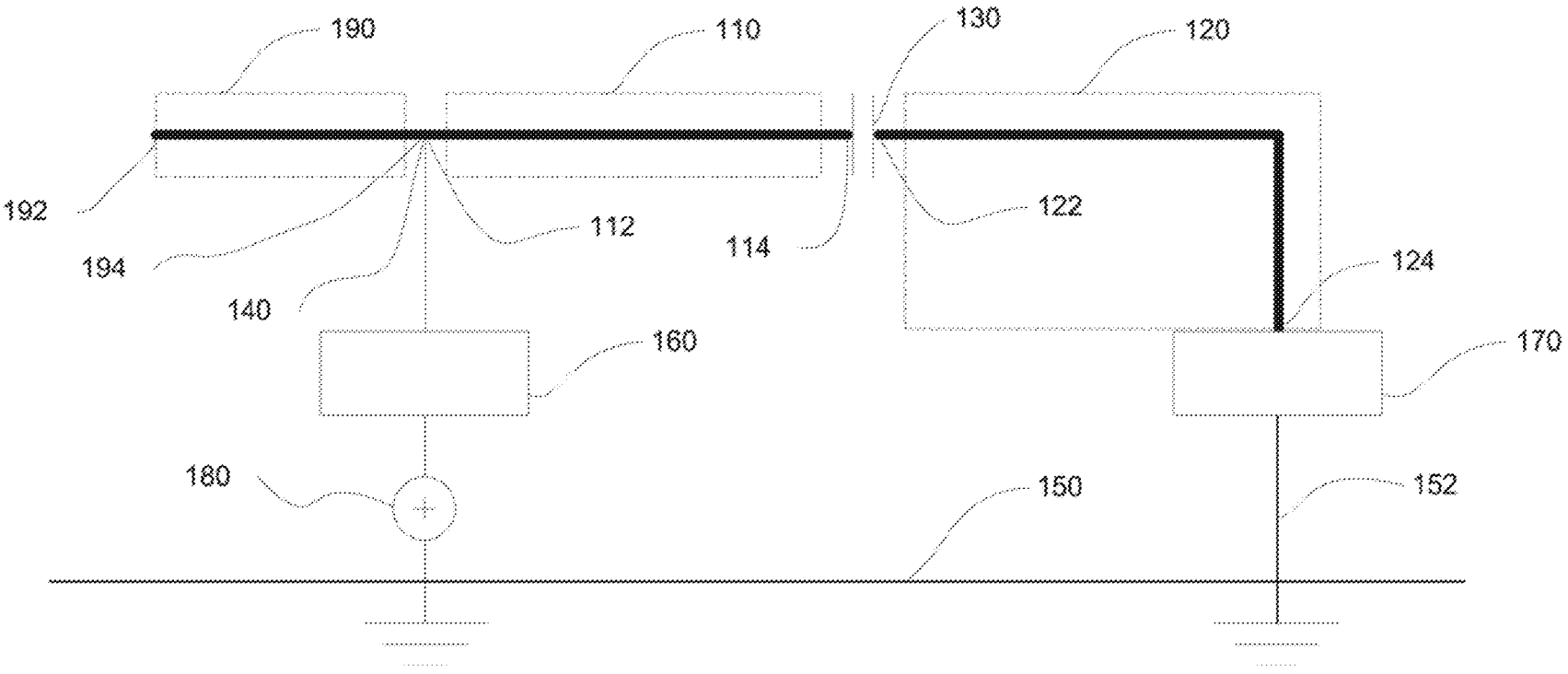
FIG. 1C is a simplified circuit diagram of another example antenna according to aspects of the disclosure.

FIG. 1C is a simplified circuit diagram of still another example antenna 100C according to aspects of the disclosure. Example antenna 100C includes many of the features of example antenna 100A, but with certain differences as discussed further below. For instance, the antenna 100C additionally includes a third radiating element 190 coupled to the first radiating element 110. The third radiating element 190 has a first end 192 which may act as an antenna opening for the antenna 100C (e.g., boundary conditions where the antenna 100A either begins or ends) and a second end 194 coupled to the first end 112 of the first radiating element 110.

The third radiating element 190 may be configured to be tunable to a third set of tuning states operating around a third set of resonant frequencies. For example, as shown, since the impedance tuner 160 is implemented at the antenna feed 140, at the second end 194 of the third radiating element 190, the impedance tuner 160 may be configured to be tune the third radiating element 190 to one of the tuning states in the third set of tuning states. In contrast to the first and second sets of tuning states, which are configured to be paired up as composite tuning states covering the same frequency ranges, the third set of tuning states may cover different frequency ranges than the first and second radiating elements 110, 120.

For instance, the third set of tuning states of the third radiating element 190 may cover the second set of frequency ranges. For example, as described above with respect to tuning states operating at harmonic frequencies of the first and/or second radiating elements 110, 120, the second set of frequency ranges may include mid-band LTE frequency ranges, such as LTE bands between 1710 MHz to 2200 MHz. In this regard, the third set of tuning states may include only one tuning state to cover the LTE bands between 1710 MHz to 2200 MHz. For another example, to further increase LTE diversity, the second set of frequency ranges may also include high-band LTE frequency ranges, such as LTE bands between 2500 MHz and 2700 MHz. In this regard, the third set of tuning states may include one additional tuning state to cover the LTE bands between 2500 MHz and 2700 MHz.

In other examples, where tuning states of the first and/or second radiating elements 110, 120 include those operating at harmonic frequencies of the first and/or second radiating elements 110, 120, and these harmonic frequencies are in the same frequency range as the third set of resonant frequencies of the third radiating element 190, the tuning states of the third radiating element 190 may be superimposed with such harmonic tuning states to provide wider troughs.

Instead of positioning the third radiating element 190 adjacent to the first radiating element 110, alternatively the third radiating element 190 may be positioned adjacent to the second radiating element 120. For example, the third radiating element may be positioned such that the first end 192 is connected to the electrical connection 152 and the second end 194 is connected to the aperture tuner 170. In this alternative arrangement, the third radiating element 190 may be configured to be tuned by the aperture tuner 170.

Figure 2A:
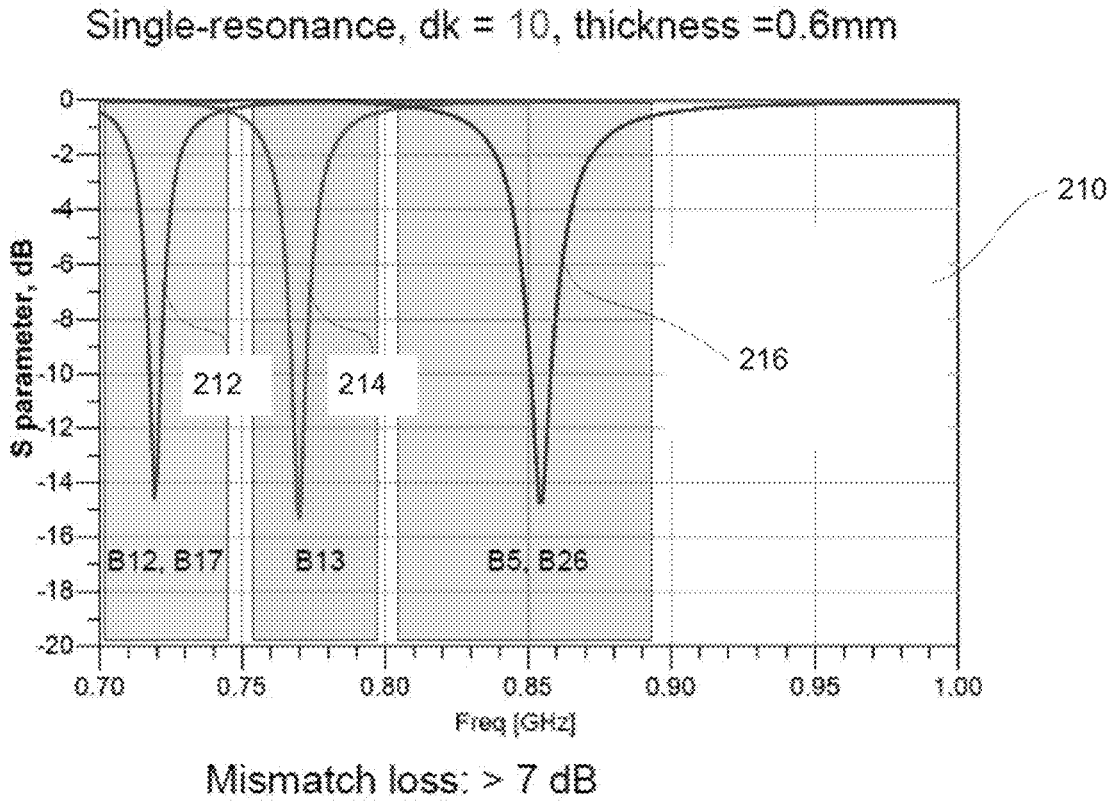
FIGS. 2A-2F are graphs showing example performance in low-band LTE frequency ranges for example antennas in accordance with aspects of the disclosure.
Figure 2B:
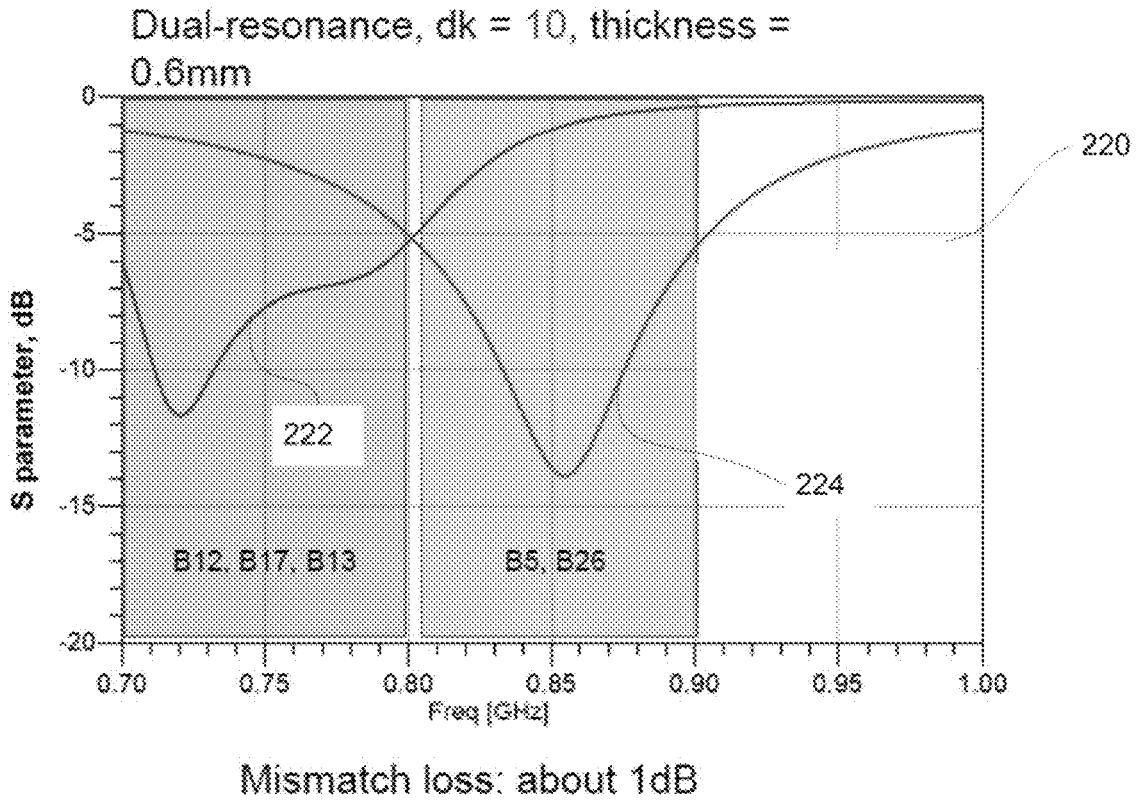
Figure 2C:
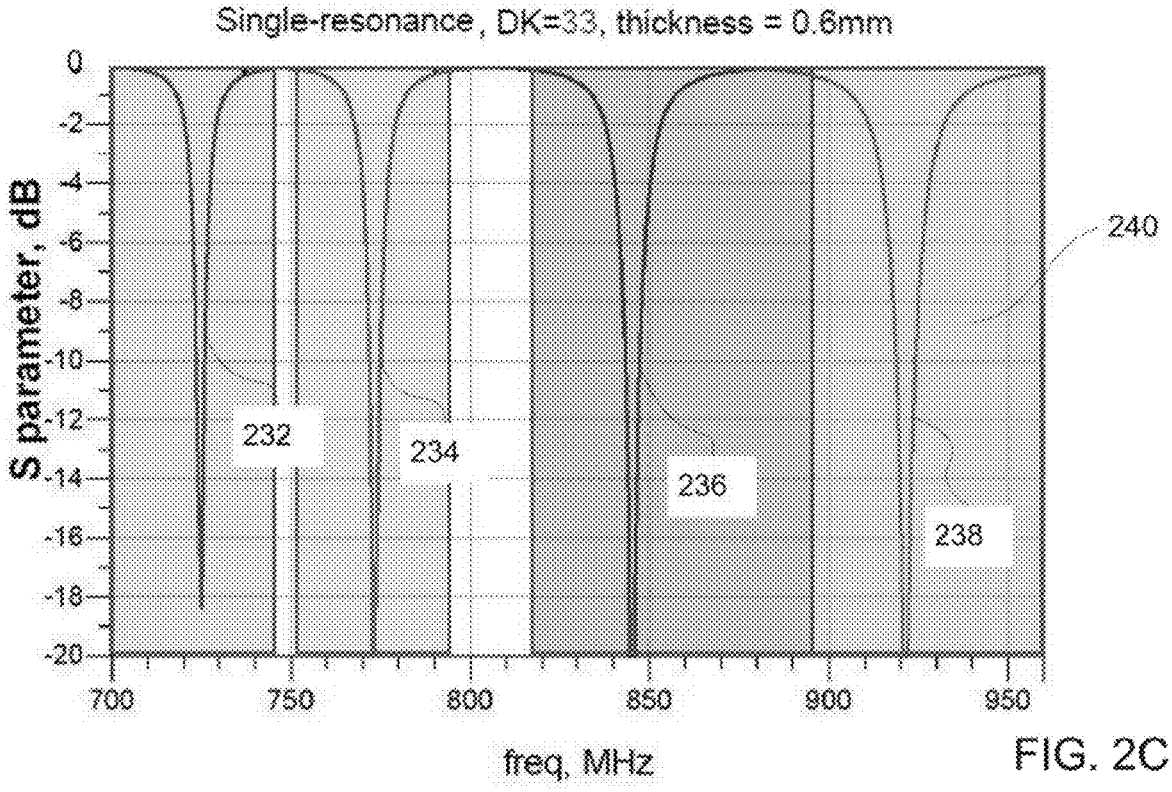
Figure 2D:
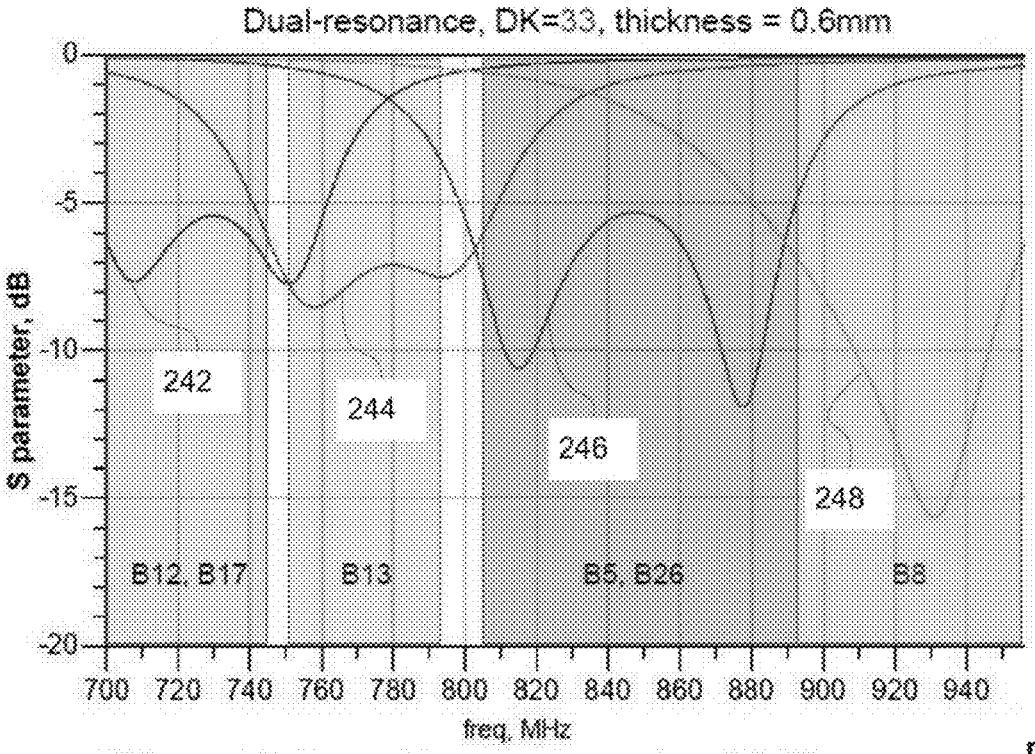
Figure 2E:
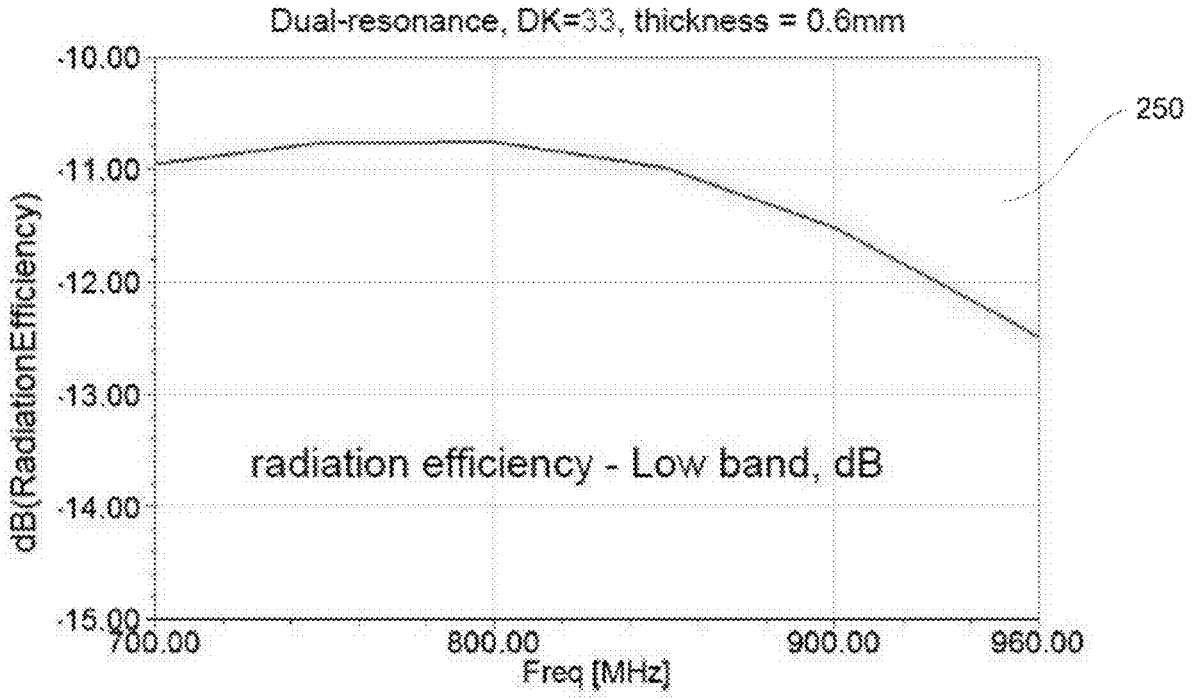

FIGS. 2A-2F show example performance in low-band LTE frequency ranges for two example antennas in accordance with aspects of the disclosure. While FIGS. 2A, 2C, and 2E show various example performance of an example antenna with one radiating element ("single-resonance"), FIGS. 2B, 2D, 2E show the corresponding example performance of an example antenna with two radiating elements whose respective tuning states can be merged into composite tuning states ("dual-resonance"), such as antennas 100A, 100B, and 100C. As such, the graphs are paired to show various performance comparisons between the example dual-resonance antenna and the example single-resonance antenna.

FIGS. 2A and 2B show performance graphs in low-band LTE frequency ranges of the two example antennas when positioned in a dielectric material with dielectric constant dk=10. For example, the dielectric material may be a glass material. For example, the dielectric material may be 0.6 mm thick. The shaded regions indicate various communication bands in the low-band LTE frequency range, such as LTE bands B12, B17, B13, B5, and B26. Graphs 210 and 220 are plots of s parameter for the low-band LTE frequency range between 700 MHz-950 MHz. The s parameter for an antenna describes the relationship between the input and the output of the antenna. Here, the s parameter plotted is S11, which is the return loss of the antenna.

Referring to FIG. 2A, the single-resonance antenna is shown to be tuned between three different tuning states operating about three resonant frequencies, which are represented by the three curves 212, 214, 216 having three different troughs. Each of the three curves thus represents a tuning state of the single-resonance antenna. Because the frequency ranges to be covered (shaded regions) are much wider than the respective troughs, the mismatch losses can be high, for example >7 dB. With each tuning state having only one narrow trough about the respective resonant frequency, only a small fraction of the low-band LTE frequency range is covered by each tuning state. As a result, even with three tuning states, only a small fraction of the low-band LTE frequency range is covered by this single-resonance antenna.

In contrast, referring to FIG. 2B, the dual-resonance antenna is shown to be tuned between two composite tuning states operating about two sets of resonant frequencies, which are represented by the two curves 222 and 224. Each of the two curves thus represents a composite tuning state of the dual resonance antenna. To select the composite tuning state, the antenna may be tuned by the impedance tuner 160 and aperture tuner 170. For example, the composite tuning state shown as curve 222 may be formed from a first tuning state of the first radiating element 110 (shown with resonant frequency around 0.72 GHz) and a first tuning state of the second radiating element 120 (shown with resonant frequency around 0.79 GHz). For another example, the composite tuning state shown as curve 224 may be formed from a second tuning state of the first radiating element 110 and a second tuning state of the second radiating element 120 (the two resonant frequencies are both around 0.84 GHz and therefore not separately visible). For yet another example (not shown), the composite tuning state shown in curve 224 may be formed from the second tuning state of the first radiating element 110 and the first tuning state of the second radiating element 120.

Thus, each of the composite tuning states formed from the two respective tuning states of the two radiating elements 110, 120 results in a wide trough. Because the width of the troughs are comparable to the frequency ranges to be covered, the mismatch losses are low, for example about 1 dB. Further, the two composite tuning states sufficiently cover all the communication bands in the low-band LTE frequency range, including LTE bands B12, B17 and B13 covered by the first trough and bands B5 and B26 covered by the second trough. Additionally the wider troughs of the dual-resonance antenna also reduce the number of tuning states needed to cover the same communication bands. For example, for the single-resonance antenna shown in FIG. 2A, three tuning states (three curves) are required to cover LTE bands B12, B17, B13, B5, and B26, while for the dual-resonance antenna shown in FIG. 2B, only two composite tuning states (two curves) are required to cover the same five LTE bands.

FIGS. 2C and 2D show performance graphs in low-band LTE frequency ranges for the two example antennas when positioned in a dielectric material with dielectric constant dk=33. For example, the dielectric may be a ceramic material, such as zirconia. For example, the dielectric material may be 0.6 mm thick. The shaded regions indicate various communication bands in the low-band LTE frequency range, such as LTE bands B12, B17, B13, B5, B26, and B8. Graphs 230 and 240 are plots of s parameter (S11) for the low-band LTE frequency range between 700 MHz-950 MHz.

In FIG. 2C, the single-resonance antenna is shown to be tuned between four different tuning states operating about four resonant frequencies, which are represented by the four curves 232, 234, 236, 238 having four different troughs. Compare FIG. 2C to FIG. 2A, as the permittivity of the housing material increases, mismatch losses for the single-resonance antenna is even greater (troughs even narrower compared to the shaded regions), for example >15 dB. As a result, even with four tuning states, only a small fraction of the low-band LTE frequency range is covered by this single-resonance antenna.

In contrast, in FIG. 2D, the dual-resonance antenna is shown tuned between four composite tuning states, which are represented by the four curves 242, 244, 246, and 248. For example, the composite tuning state shown as curve 242 may be formed from a first tuning state of the first radiating element 110 (shown with resonant frequency around 710 MHz) and a first tuning state of the second radiating element 120 (shown with resonant frequency around 750 MHz). For another example, the composite tuning state shown as curve 244 may be formed from a second tuning state of the first radiating element 110 (shown with resonant frequency around 800 MHz) and the first tuning state of the second radiating element 120 (shown with resonant frequency around 750 MHz). For yet another example, the composite tuning state shown in curve 246 may be formed from the second tuning state of the first radiating element 110 (shown with resonant frequency around 815 MHz) and a second tuning state of the second radiating element 120 (shown with resonant frequency around 880 MHz). For still another example, the composite tuning state shown in curve 248 may be formed from a third tuning state of the first radiating element 110 and a third tuning state of the second radiating element 120 (the two resonant frequencies are both around 930 MHz and therefore not separately visible).

Thus, each of the composite tuning states formed from the two respective tuning states of the two radiating elements 110, 120 results in a wide trough. Because the frequency ranges to be covered are comparable to the wide troughs, the mismatch losses are low, for example about 1 dB. Further, the four composite tuning states sufficiently cover all the communication bands in the low-band LTE frequency range, including LTE bands B12 and B17 covered by the first trough, B13 covered by the second trough, bands B5 and B26 covered by the third trough, and band B8 covered by the fourth trough.

Figure 2F:
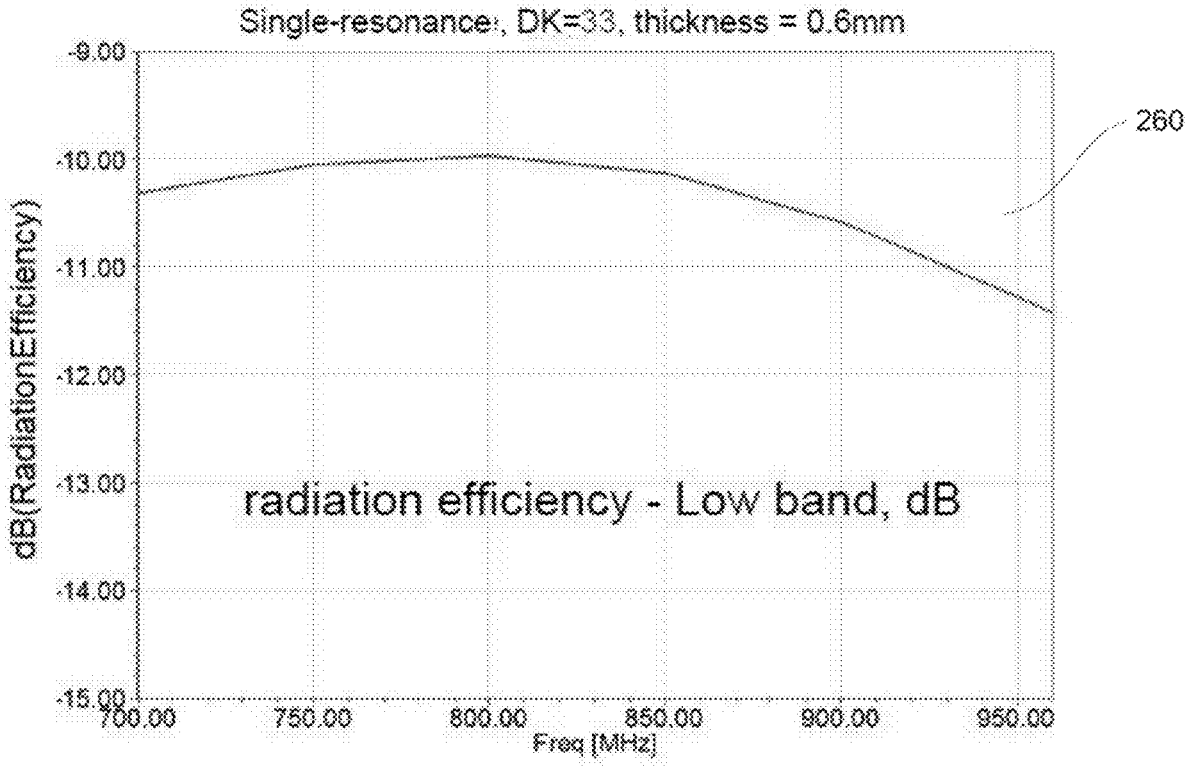

FIGS. 2E and 2F show another set of performance graphs in low-band LTE frequency ranges for the two example antennas positioned in the dielectric material with dielectric constant dk=33. Graphs 250 and 260 are plots of radiation efficiency for the low-band LTE frequency range between 700 MHz-950 MHz. The radiation efficiency of an antenna is a ratio of the power delivered to the antenna relative to the power radiated from the antenna. Thus, as shown in graph 250 of FIG. 2E, the radiation efficiency for the single-resonance antenna is between −10 dB and just below −11 dB. As shown in graph 260 of FIG. 2F, the radiation efficiency for the dual-resonance antenna is between just above −11 dB and just below −12 dB. Since performance guidelines for a given smartwatch or other wearable device may require about −10 dB in radiation efficiency, in this case the dual-resonance antenna is able to provide radiation efficiency about the guideline.

Figure 3:
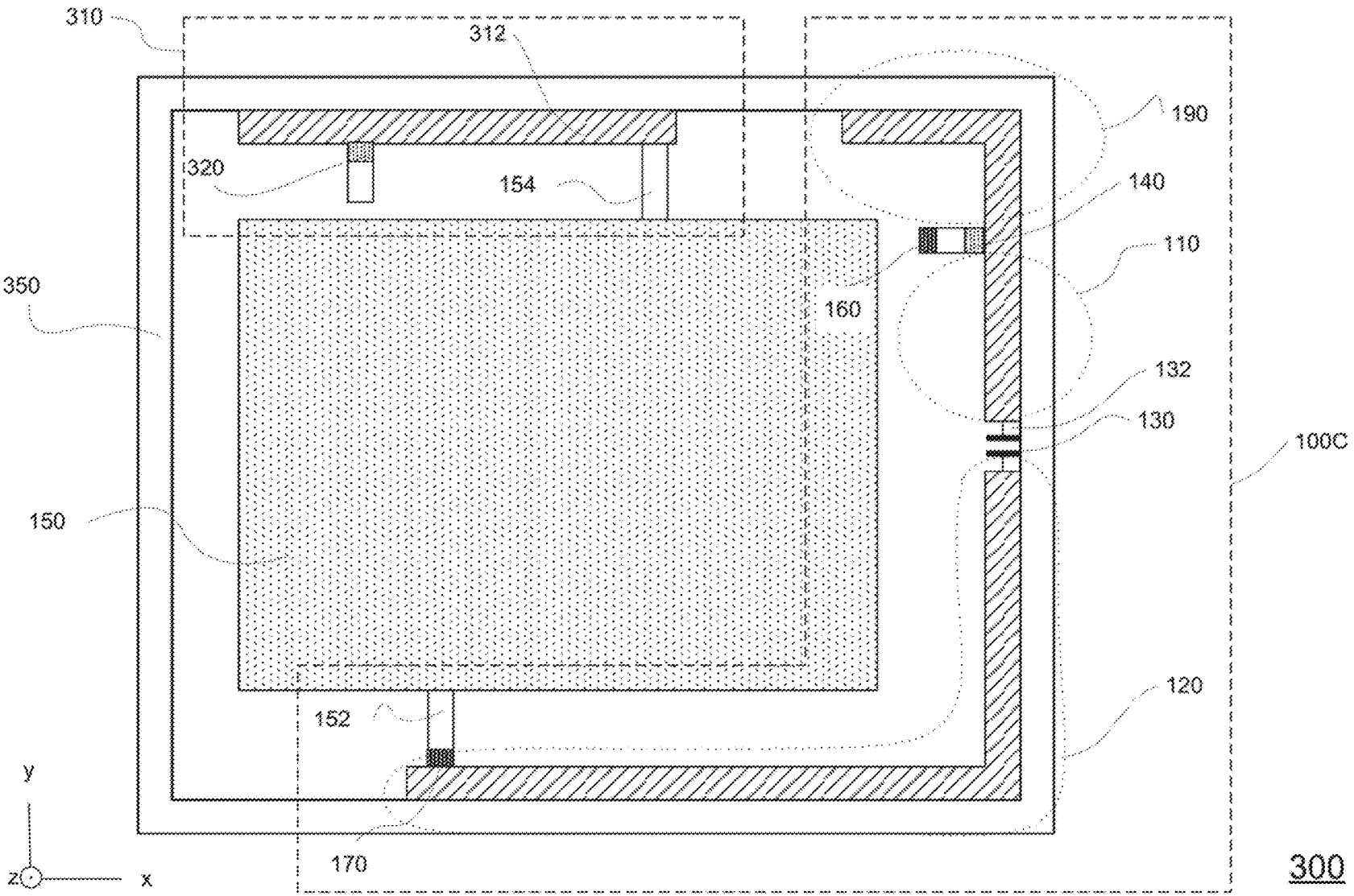
FIG. 3 is a block diagram illustrating an example antenna system according to aspects of the disclosure.

FIG. 3 shows an example antenna system 300 according to aspects of the disclosure. The antenna system 300 includes a first antenna having multiple radiating elements, such as antenna 100C (components shown in dashed-line box), and a second antenna 310 (components shown in dashed-line box). In other examples, the first antenna may also be implemented as antenna 100A or 100B. Here, instead of a circuit diagram, a simplified schematic shows example relative positions of the various components of antenna 100C that may be used for the antenna system 300. For instance, the first radiating element 110 and the second radiating element 120 is physically separated by a space 132. The loading capacitor 130 is positioned within the space 132 and electrically connected to both the first radiating element 110 and the second radiating element 120. Although the third radiating element 190 is physically connected to the first radiating element 110, the antenna feed 140 defines the boundary between the first and third radiating elements 110 and 190. As shown, the impedance tuner 160 is provided at the antenna feed 140 while the aperture tuner 170 is positioned at the electrical connection 152. The electrical connection 152 is shown to connect the antenna 100C to the ground plane 150.

The second antenna 310 may be any type of antenna, for example, a monopole antenna, a dipole antenna, a planar antenna, a slot antenna, a hybrid antenna, a loop antenna, an inverted-F antenna, etc. The second antenna 310 includes a fourth radiating element 312. The fourth radiating element 312 may be made of any of a number of conductive materials, such as metals and alloys. The fourth radiating element 312 may be configured to be tunable to a fourth set of tuning states operating around a fourth set of resonant frequencies. For example, one or more resonant frequencies from the fourth set of resonant frequencies may be in frequency ranges centered at 1575.42 MHz for GPS signals, or between 2400 MHz and 2484 MHz for WiFi signals. As such, the antenna system 300 may provide coverage of LTE communication bands via antenna 100C, and coverage of GPS/WiFi communication bands via the second antenna 310.

The second antenna 310 includes one or more antenna feeds. For example, as shown, the second antenna 310 includes an antenna feed 320. In some examples (though not shown), the second antenna 310 may be capacitively fed by a feed structure positioned proximate to the antenna feed 320. Further, an electrical connection 154 is provided to short the fourth radiating element 312 of the second antenna 310 to the ground plane 150. This way, with limited space, a larger ground plane 150 may be shared by both antennas 100C and 310, as opposed to having two smaller, discrete ground planes. In addition, by positioning the electrical connection 154 at an end of the fourth radiating element 312, the electrical connection 154 may also act as one of the antenna openings for the second antenna 310 (e.g., boundary conditions where the second antenna 310 either begins or ends). Additionally, although not shown, the second antenna 310 may further include one or more tuners, such as an impedance tuner or an aperture tuner.

The example antenna system 300 described above may be implemented in a ring-like or arcuate-type configuration. This way, the antenna system 300 may be housed in a periphery of a small electronic device, such as a smartwatch or a smart phone. Such an arrangement not only saves space, but may also reduce interference between the antenna system 300 in the periphery and other electronic components at the center of the electronic device. For example, parts of the antenna system 300, such as the first, second, third, and fourth radiating elements 110, 120, 190, 312, may be plated directly onto an inside surface of a housing material 350. The housing material 350 may be a permittivity material, such as glass or ceramic. Since the radiating elements 110, 120, 190, 312 are plated onto non-conductive housing material 350, the boundary conditions of the antennas 100C and 310 may simply be the ends of the plating materials. In addition, other antenna components, such as the various tuners 160, 170, and antenna feeds 140, 320, may also be plated directly onto the housing material 350 if they are positioned above or below the radiating elements 110, 120, 190, 312 in the z-direction.

As an alternative to directly plating the radiating elements 110, 120, 190, 312 onto the housing material 350, the radiating elements 110, 120, 190, 312 may be plated onto one or more plastic components, where the plastic components are joined onto an inside surface of the housing material 350. For example, to better control air gaps formed between the radiating elements 110, 120, 190, 312 and the housing material 350, the plastic components may be insert-molded onto the housing material 350. For another example, the plastic component may be a plastic housing fitted tightly inside the housing material 350 such that the radiating elements 110, 120, 190, 312 may be plated onto an outer surface of the plastic housing facing the inside surface of the housing material 350. Likewise, other antenna components, such as the various tuners 160, 170, and antenna feeds 140, 320, may also be plated onto the plastic components. Although the housing material 350 is shown as a rectangle, the housing may alternatively be any of a number of geometric shapes, for example, a square, a circle, an oval, a triangle, or any other polygon.

FIGS. 4A-4F show example performance in mid-band and high-band LTE frequency ranges, as well as WiFi/GPS frequency ranges for an example antenna system in accordance with aspects of the disclosure. For example, the graphs may represent example performance of the antenna system 300.

Figure 4A:
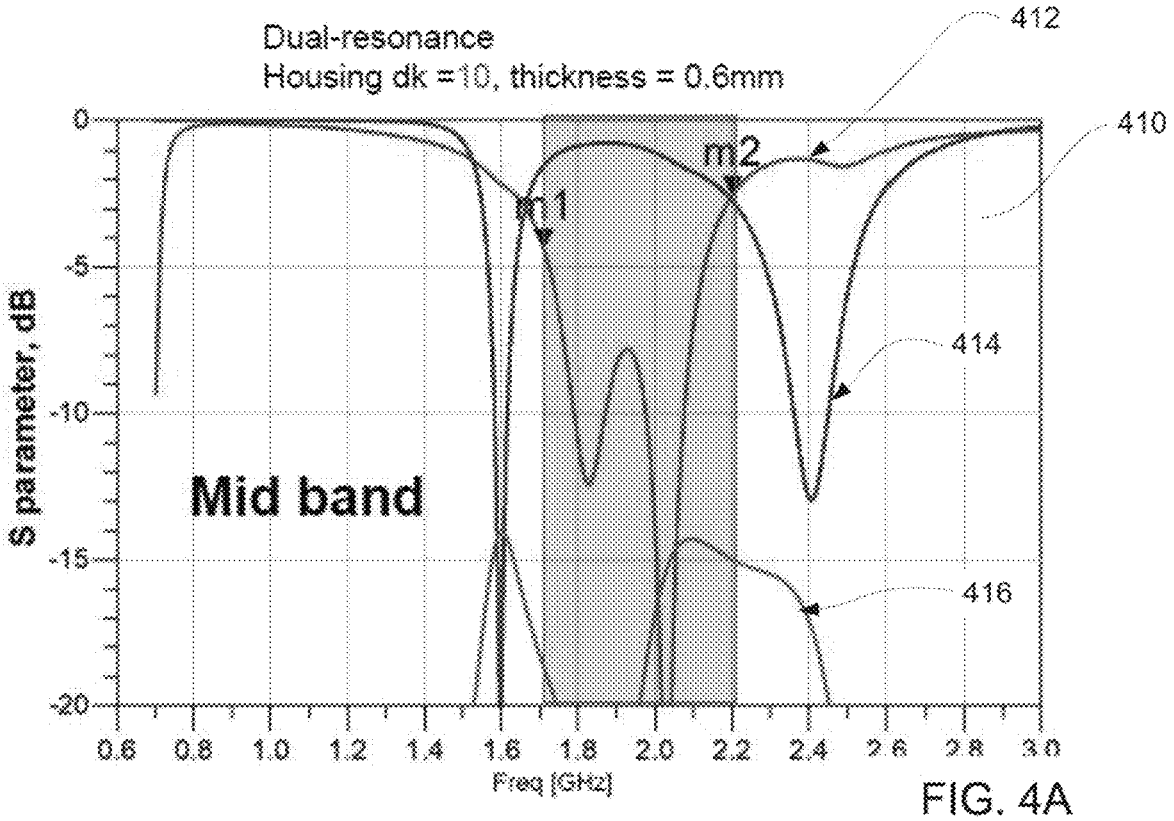
FIGS. 4A-4F are graphs showing example performance systems in mid-band and high-band LTE frequency ranges, and WiFi/GPS frequency ranges for example antenna systems in accordance with aspects of the disclosure.
Figure 4B:
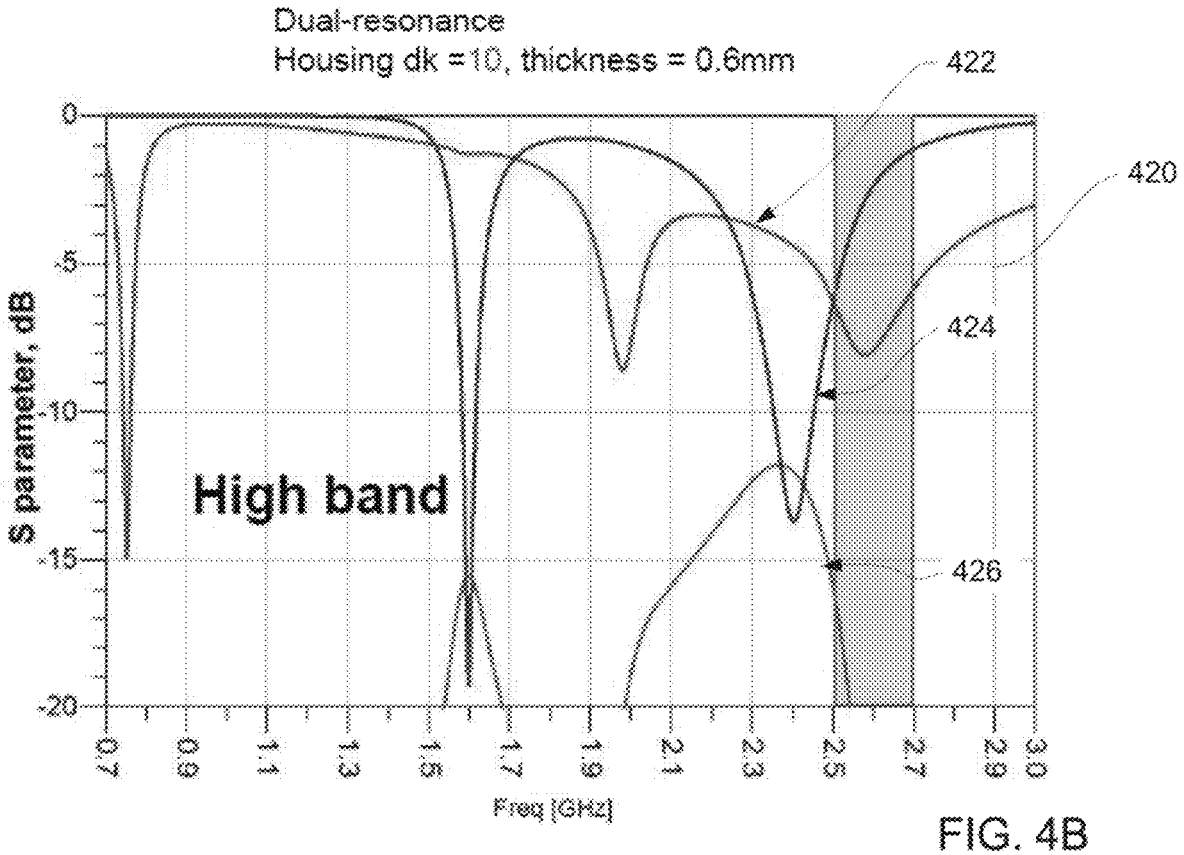

FIGS. 4A and 4B show a set of performance graphs for the antenna system when positioned in a housing made of dielectric material with dielectric constant dk=10. For example, the dielectric material may be a glass material. For example, the dielectric material may be 0.6 mm thick. In FIG. 4A, the antenna 100C is tuned to a tuning state for covering the mid-band LTE frequency range, while in FIG. 4B, the antenna 100C is tuned to a tuning state for covering the high-band LTE frequency range. The shaded regions indicate various communication bands in the mid-band and/or high-band LTE frequency ranges, such as LTE bands B2 and B4 in mid-band LTE frequency range for FIG. 4A, or B40, B41, and B7 in high-band LTE frequency range for FIG. 4B.

In FIG. 4A, graph 410 plots the s parameter (S11) for the antenna system 300 when the antenna 100C is tuned to the tuning state for covering the mid-band LTE frequency range between 1710 MHz to 2200 MHz. As shown, curve 412 is a plot of the s parameter of the antenna 100C. For example, curve 412 may be a superimposition of a tuning state of the first radiating element 110 (shown with resonant frequency around 1.8 GHz) and a tuning state of the third radiating element 190 (shown with resonant frequency around 2.05 GHz), where the tuning state of the first radiating element 110 is operating at a harmonic frequency. As such, the superimposed tuning state provides a wider trough than the respective tuning states, which therefore provides greater bandwidth and lower mismatch loss.

Curve 414 is a plot of the s parameter of the second antenna 310, which shows one trough around 1575.42 MHz for GPS signals, and one trough around 2400 MHz-2484 MHz for WiFi signals. As such, the second antenna 310 provides adequate coverage of the GPS and WiFi frequency ranges. Curve 416 is a plot of the s parameter showing coupling effects between the antenna 100C and the second antenna 310. As shown, there is up to −14 dB of coupling between 1.5-1.75 GHz, and between 1.95-2.45 GHz. Thus, antenna coupling between the antenna 100C and the second antenna 310 is well below −10 dB (or isolation above 10 dB). This shows performance better than the guideline performance of 10 dB isolation.

In FIG. 4B, graph 420 plots of s parameter (S11) for the antenna system 300 when the antenna 100C is tuned to the tuning state for covering the high-band LTE frequency range between 2500 MHz to 2700 MHz. As shown, curve 422 is a plot of the s parameter of the antenna 100C. For example, curve 422 may be a single tuning state of the third radiating element 190. Or as another example, curve 422 may be a superimposition of a tuning state of the second radiating element 120 and a tuning state of the third radiating element 190 (the two resonant frequencies are both around 2.4 GHz and therefore not separately visible), where the tuning state of the second radiating element 120 is operating at a harmonic frequency. As such, the superimposed tuning state provides a wider trough than the respective tuning states, which therefore provides greater bandwidth and lower mismatch loss.

Curve 424 is a plot of the s parameter of the second antenna 310, which has one trough around 1575.42 MHz for GPS signals, and one trough around 2400 MHz-2484 MHz for WiFi signals. As such, the second antenna 310 provides adequate coverage of the GPS and WiFi frequency ranges. Curve 426 is a plot of the s parameter showing coupling effects between the antenna 100C and the second antenna 310. As shown, there is up to −16 dB of coupling between 1.5-1.7 GHz, and up to −12 dB of coupling between 1.95-2.45 GHz. Thus, antenna coupling between the antenna 100C and the second antenna 310 is well below −10 dB (or isolation above 10 dB). This shows performance better than the guideline performance of 10 dB isolation.

Figure 4C:
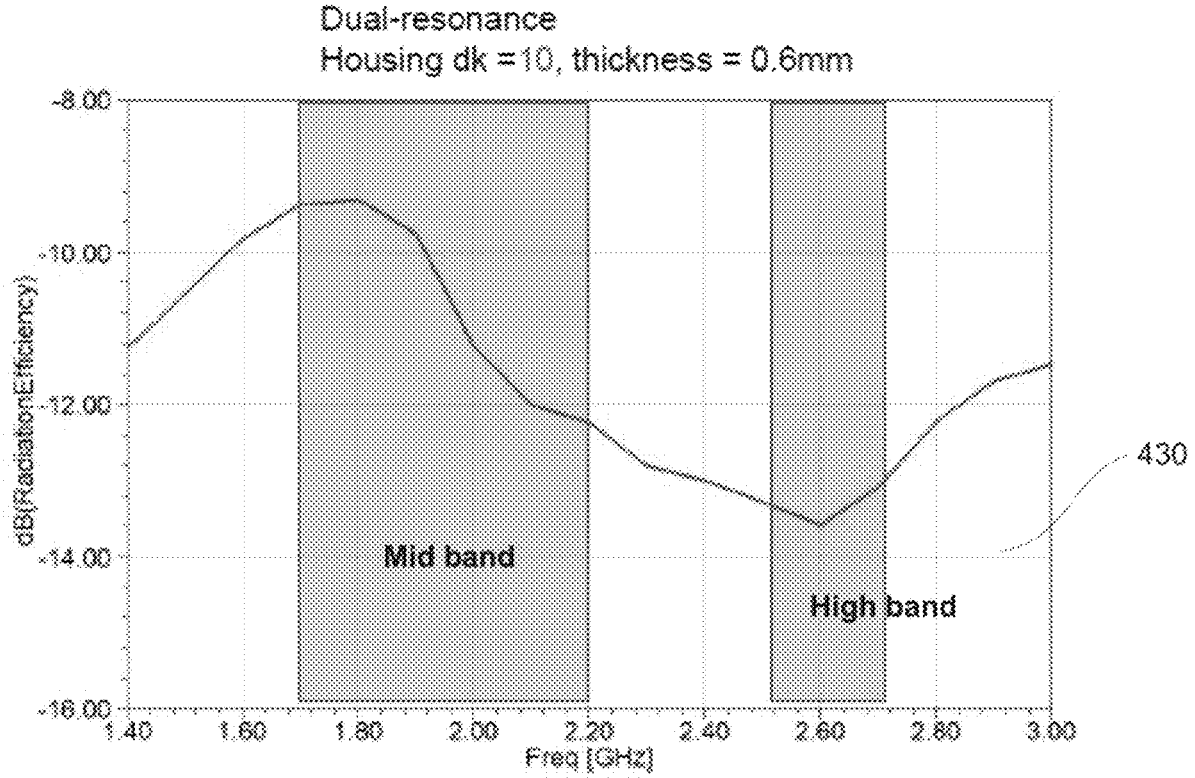
Figure 4D:
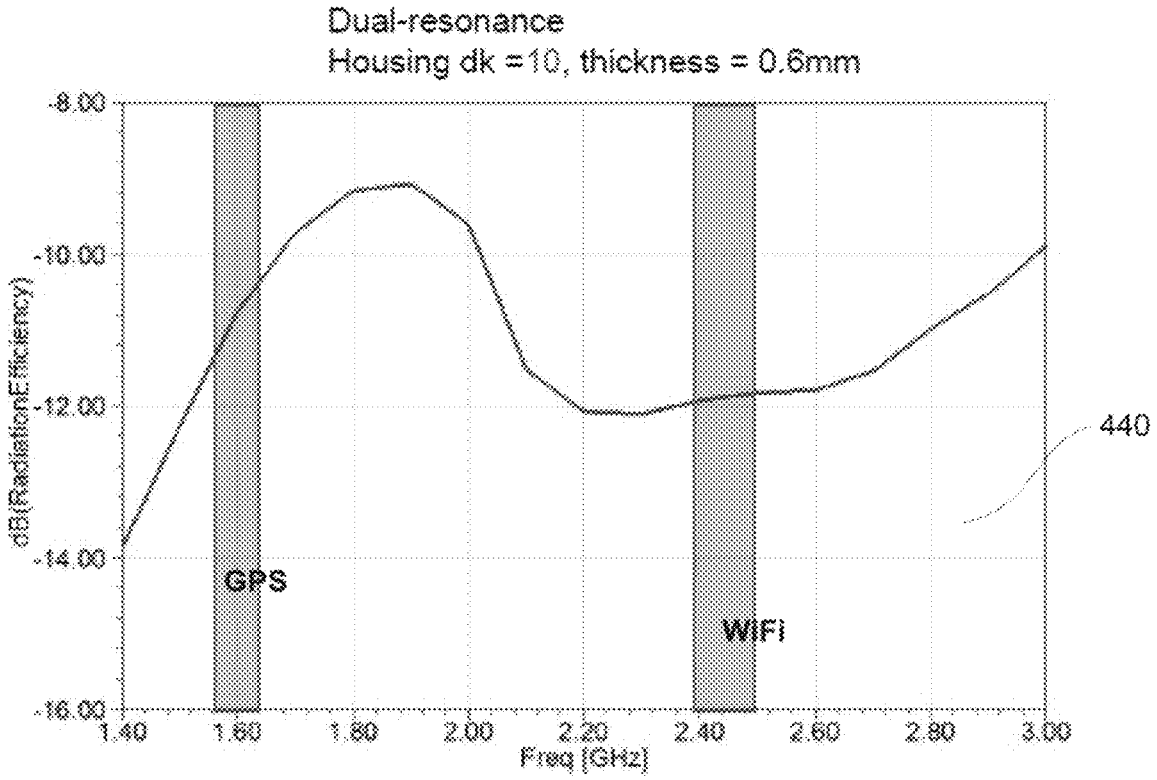

FIGS. 4C and 4D show another set of performance graphs for the antenna system positioned in a housing made of dielectric material with dielectric constant dk=10. In FIG. 4C, plot 430 shows the radiation efficiency of the antenna 100C fluctuates between just below −12 dB and just below −9 dB for the mid-band LTE frequency range between 1.71 GHz to 2.2 GHz (shaded), and between just above −14 dB and −13 dB for the high-band LTE frequency range between 2.5 GHz to 2.7 GHz (shaded). In FIG. 4D, plot 440 shows the radiation efficiency for the second antenna 310 fluctuates between just below −11 dB and just below −10 dB for GPS frequency range (shaded), and around −12 dB for WiFi frequency range (shaded). Thus, the antenna 100C and the second antenna 310C both provide performance around the performance guideline of −10 dB.

Figure 4E:
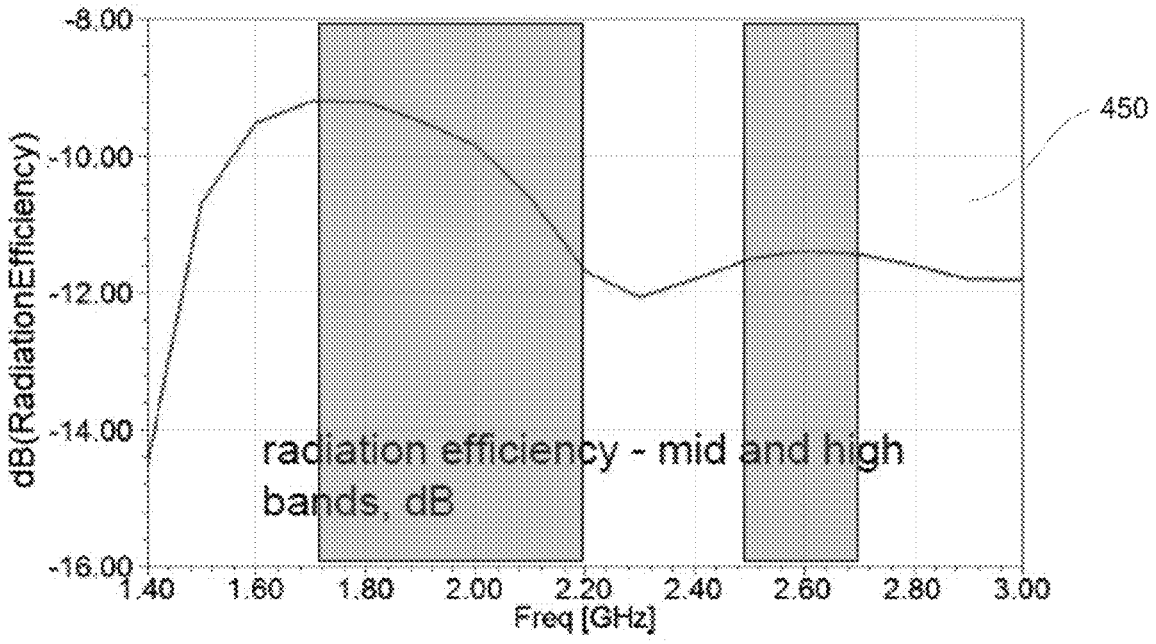
Figure 4F:
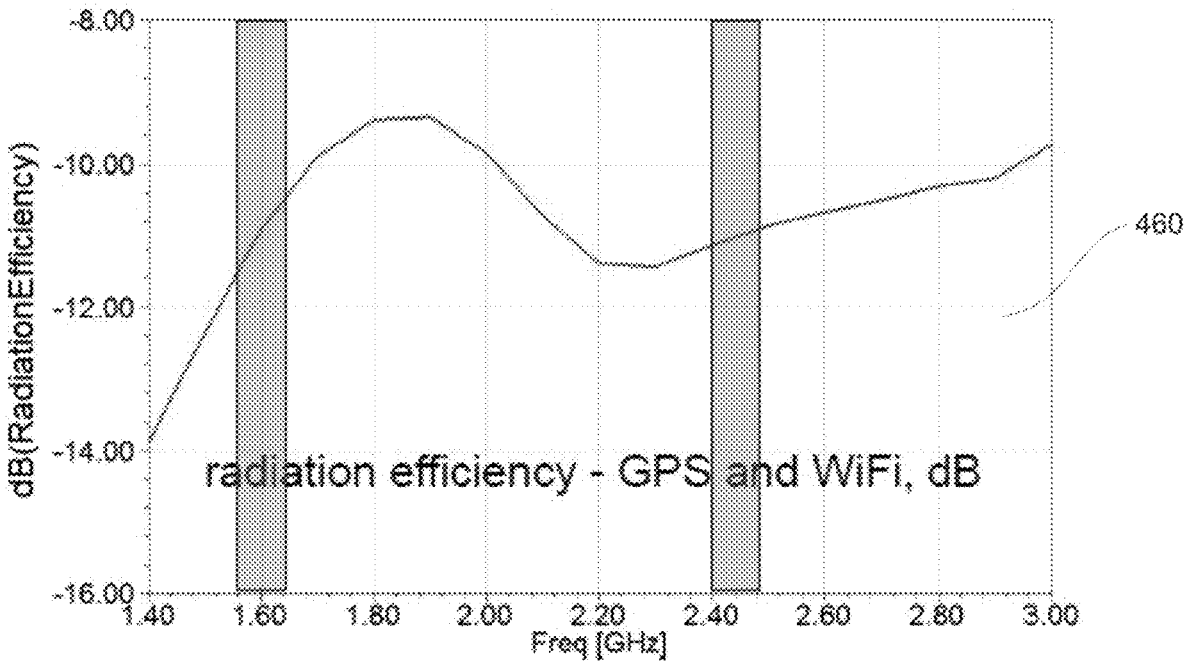

FIGS. 4E and 4F show a set of performance graphs for the antenna system when positioned inside a housing made of dielectric material with dielectric constant dk=33. For example, the dielectric may be a ceramic material, such as zirconia. For example, the dielectric material may be 0.6 mm thick. In FIG. 4E, plot 450 shows the radiation efficiency of the antenna 100C fluctuates between just above −12 dB and just below −9 dB for the mid-band LTE frequency range between 1.71 GHz to 2.2 GHz (shaded), and around −12 dB for the high-band LTE frequency range between 2.5 GHz to 2.7 GHz (shaded). In FIG. 4F, plot 460 shows the radiation efficiency for the second antenna 310 fluctuates between just above −12 dB and just below −10 dB for GPS frequency range (shaded), and around −11 dB for WiFi frequency range (shaded). Thus, the antenna 100C and the second antenna 310C both provide performance around the performance guideline of −10 dB.

Figure 5A:
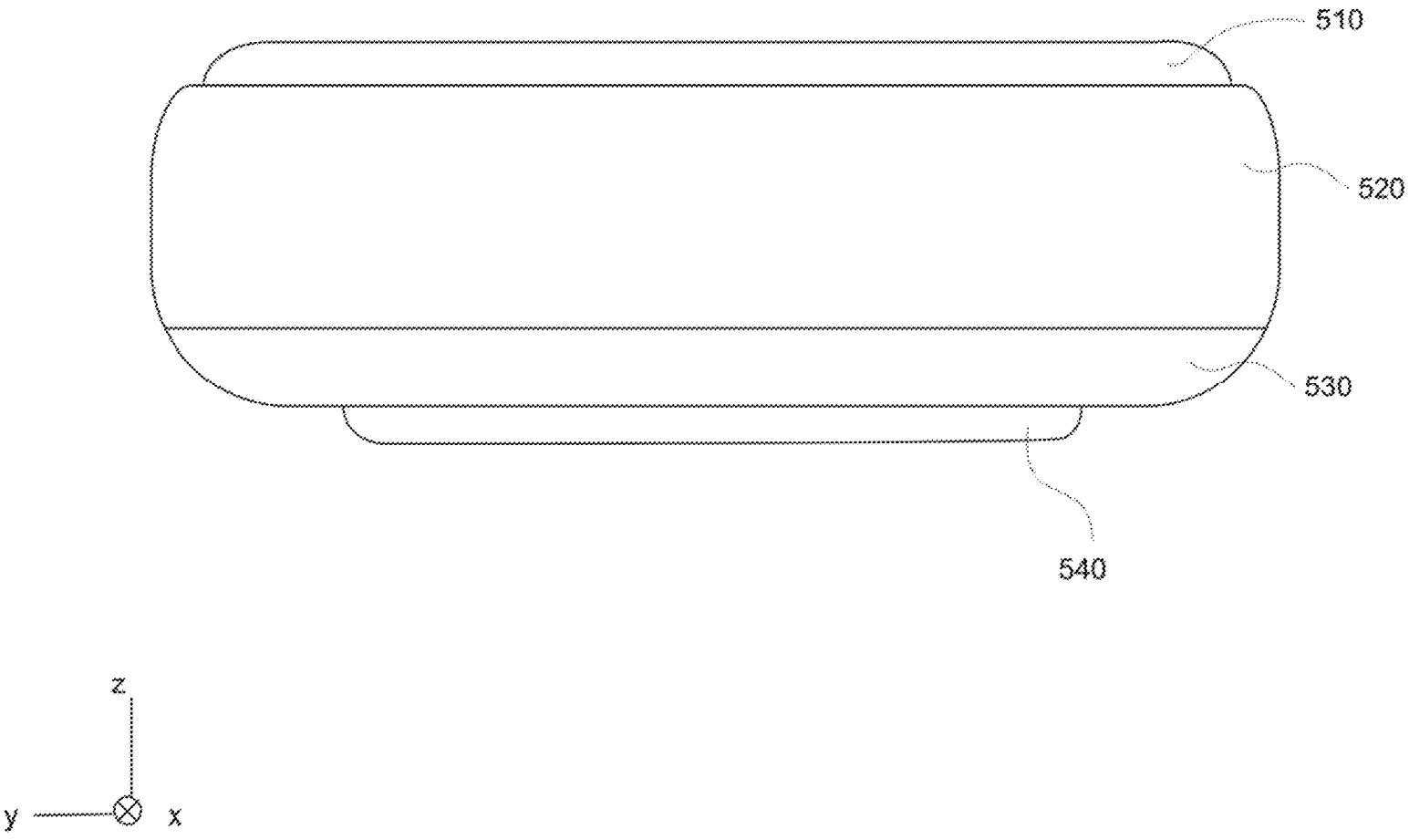
FIGS. 5A-5C are block diagrams illustrating an example device in accordance with aspects of the disclosure.
Figure 5B:
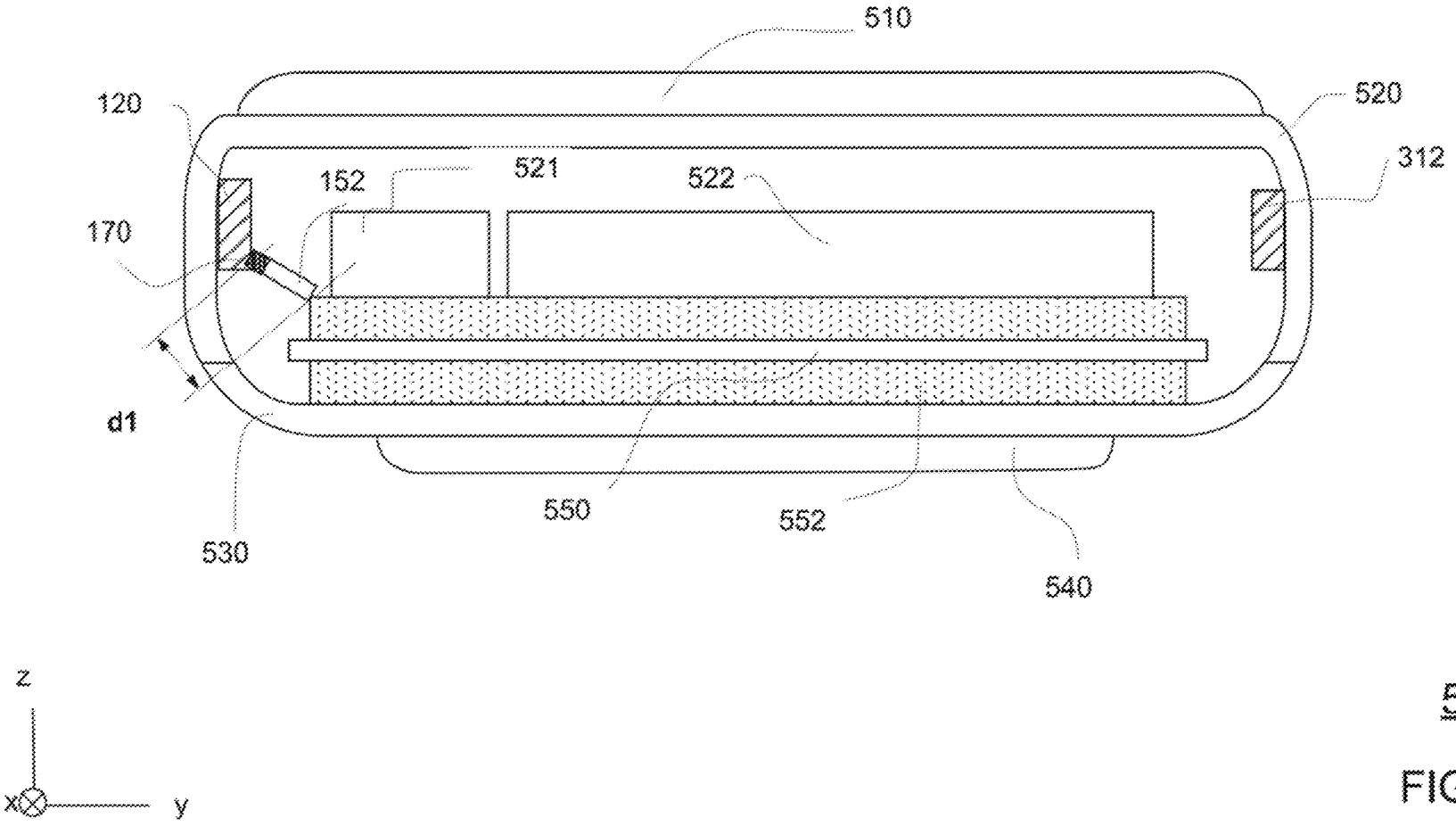
Figure 5C:
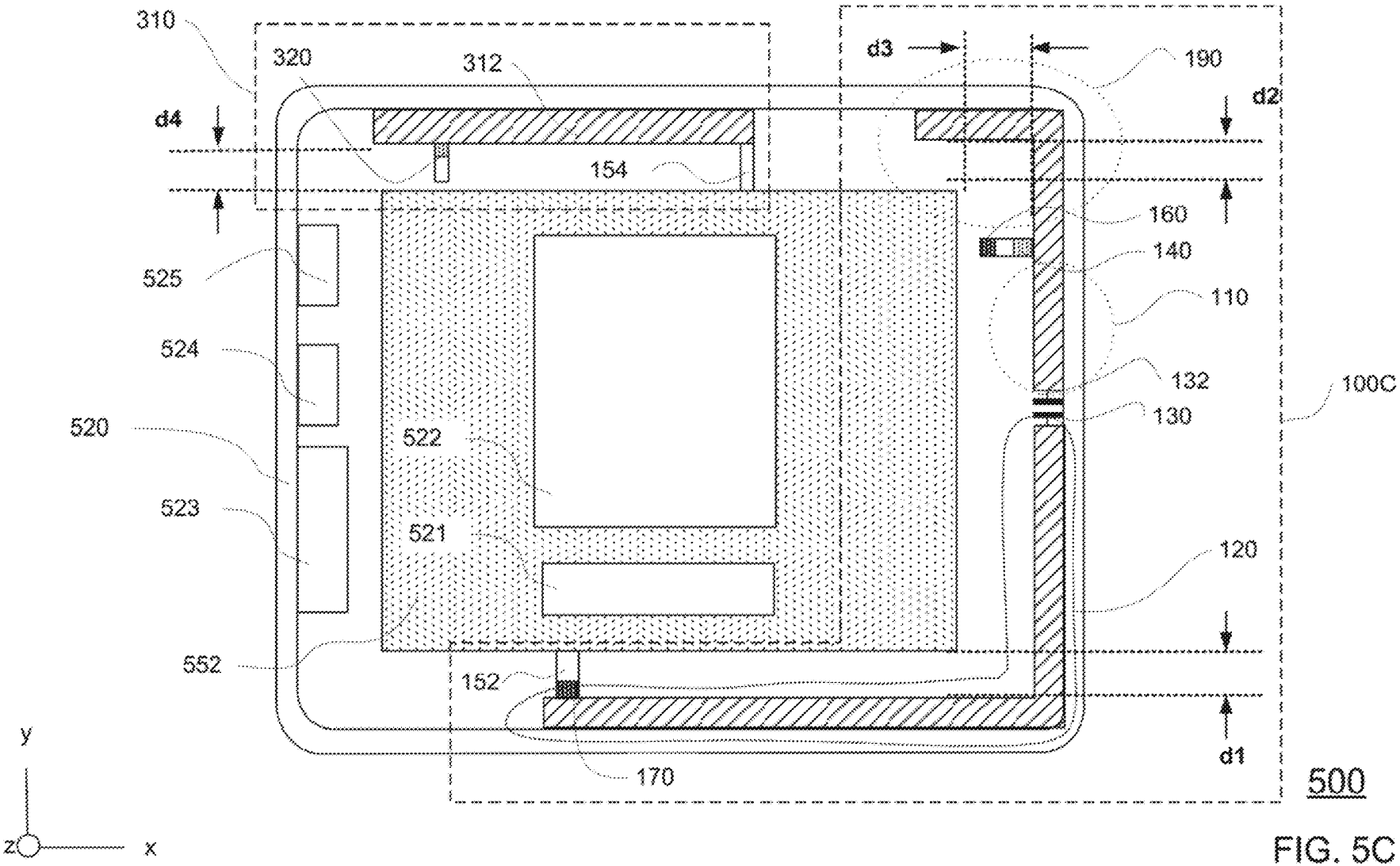

FIGS. 5A-5C show various views of an example wearable device 500 having an antenna system according to aspects of the disclosure. For example, as shown in FIG. 5C, the wearable device 500 incorporates the antenna system 300. For example, the wearable device 500 may be a smart watch. For ease of illustration, a watch strap, band or other connection mechanism is omitted for clarity. FIG. 5A shows a side view of an exterior of the wearable device 500. FIG. 5B shows a side view of a cross section of the wearable device 500. FIG. 5C shows a top view of another cross section of the wearable device 500.

As shown in FIGS. 5A and 5B, the wearable device 500 has a front cover 510 to enable viewing of and interaction with a display. For example, the display may be a screen or a touch screen, and the cover may be glass or other suitable material. The front cover 510 has a first surface configured to face the user, and a second surface opposite the first surface. A housing 520 has a first side attached to the front cover 510, e.g., along the second surface thereof, to provide support and protection to various electronic and/or mechanical components of the wearable device 500. For example, as shown in the cross section view of FIG. 5B, the various electronic and/or mechanical components inside the housing 520 may include the antenna system 300 (from this view, only the second radiating element 120, electrical connection 152, and aperture tuner 170 of the antenna 100C; and the fourth radiating element 312 of the second antenna 310 are visible), a haptic motor 521, a battery 522, and a circuit board 550 with a shielding can 552 (which may be used as the ground plane of the antenna 100C and/or the second antenna 310). The housing 520 may be made of any of a number of dielectric materials. For example, the dielectric material may be a glass (such as coming, NEG) or a ceramic material (such as zirconia or alumina). For mechanical strength and durability, the housing may be 0.5 mm-1 mm thick.

Remote from the front cover 510, a back cover 530 is attached to a second side of the housing 520. In particular, a first surface of the back cover 530 is attached to the second side of the housing 520. The back cover 530 may be made of a non-metallic material, such as a ceramic, a glass, a plastic or combinations thereof, to provide further insulation between the various electronic components of the wearable device 500 and the wearer's skin. As such, the back cover 530 may reduce body effects such as detuning, attenuation, and shadowing of the antennas 100C and 310 due to the wearer's skin. Alternatively, the back cover 530 may be made of a metallic material. In this regard, the back cover 530 may be provided with a connection to the circuit board 550 with shielding can 552, thus sharing a ground with the antenna 110C and/or the second antenna 310. The back cover 530 may also provide greater separation of the antenna system 300 from the wearer's skin than, for example, configuring the antenna system 300 in a wristband of the wearable device 500.

Additionally, a back plate 540 is shown attached to a second surface of the back cover 530, remote from the housing 520. The back plate 540 is configured to provide further insulation between the various electronic components of wearable device 500 and the wearer's skin. The back plate 540 may be made of any of a number of materials, for example, a glass, a ceramic, a plastic or combinations thereof. The combination of the back cover 530 and the back plate 540 may provide even greater separation of the antenna system 300 from the wearer's skin than having the back cover 530 alone. This combination further reduces body effects such as detuning, attenuation, and shadowing of the antennas 100C and 310 due to the wearer's skin.

Referring to FIG. 5C, which shows the top view of another cross section of the wearable device 500, the first, second, third, and fourth radiating elements 110, 120, 190, and 312 may be conductive material plated directly onto one or more inside surfaces of the housing 520. As discussed above with respect to FIG. 3, as an alternative, the conductive material may be plated on plastic components that are insert-molded onto inside surfaces of the housing 520. This way, interference from other components housed near the center of the wearable device 500 may be reduced. The ground plane of the antenna 100C and/or the second antenna 310 may be implemented using an element positioned inside the housing 520. For example, the ground plane for both the antennas 100C and 310 may be the circuit board 550 (such as a PCB) with the shielding can 552. As shown, electrical connections 152 and 154 connect antennas 100C and 310 respectively to the circuit board 550 with shielding can 552. The top view in FIG. 5C also shows various electronic and/or mechanical components inside the housing 520, including the haptic motor 521, the battery 522, a speaker 523, a microphone 524, and one or more sensors 525.

The wearable device 500 may be any of a number of wearable personal computing devices, such as a smartwatch, and may have specific dimension requirements due to the device type. For example, a smartwatch should fit comfortably on a wrist, be able to withstand some impact, have a screen large enough for displaying texts and simple graphics, and have enough space inside for various mechanical and electronic components, including a battery large enough not to require very frequent recharges. For example, the front cover 510 may have a length (x-direction) and/or width (y-direction) of 20-50 mm, and a height/thickness (z-direction) of 0.5-1 mm. The housing 520 may have a similar length and/or width as that of the front cover 510, and a height of 5-10 mm. The back cover 530 may have a similar length and/or width as that of the housing 520, and a height of 1-5 mm. The back plate 540 may have a length and/or width equal to or smaller than that of the back cover 530, and a height of 1-3 mm. Although each exterior surface of the wearable device 500 is shown as having generally a rounded rectangular shape, the exterior surfaces of the wearable device 500 may alternatively be any of a number of geometric shapes, for example, a square, a circle, an oval, a triangle, or any other polygon, and have analogous dimension requirements as described above.

As the dimensions of the housing 520 are constrained by the overall size of the electronic device, the dimensions of the antennas 100C and 310 are similarly constrained. For example, the first, second, and third radiating elements of the antenna 100C may each have a width (x- or y-direction) of 1 mm-5 mm, a length (x- or y-direction) of 10-50 mm, and a height (z-direction) of 1 mm-5 mm. For another example, the second antenna 310 may have a width (y-direction) of 1 mm-5 mm, a length (x-direction) of 10 mm-50 mm, and a height (z-direction) of 1 mm-5 mm. Optionally, if plastic components are used for plating the radiating elements (such as by insert-molding onto the housing 520), the plastic components may have a thickness of around 0.5 mm.

The circuit board 550 with the shielding can 552, which as discussed above is used as ground plane 150 for the antennas 100C and 310, are also restricted in size by the dimensions of the housing 520. For example, the circuit board 550 and the shielding can 552 may each have a width and/or length (x- or y-direction) of 15-45 mm. As shown in FIGS. 5B and 5C, a clearance d1 between the second radiating element 120 of antenna 100C and the circuit board 550 and/or the shielding can 552 may be 0.8-2 mm, a clearance distance d2 between the third radiating element 190 of antenna 100C and the circuit board 550 and/or the shielding can 552 may be 0.8-2 mm. A clearance distance d3 between the first or second radiating element 110, 120 of antenna 100C and the circuit board 550 and/or the shielding can 552 may be 0.8-2 mm. Likewise, a clearance distance d4 between the fourth radiating element 312 of the second antenna 310 and the circuit board 550 and/or the shielding can 552 may also be 0.8-2 mm.

FIGS. 6A-6E show example performance with respect to body effects for an example wearable in accordance with aspects of the disclosure. For example, the graphs may represent example performance of the wearable device 500. For example, the graphs may represent example performance for the antenna system 300 positioned inside a housing made of dielectric material with dielectric constant dk=10. For example, the dielectric material may be a glass material. For example, the dielectric material may be 0.6 mm thick.

Figure 6A:
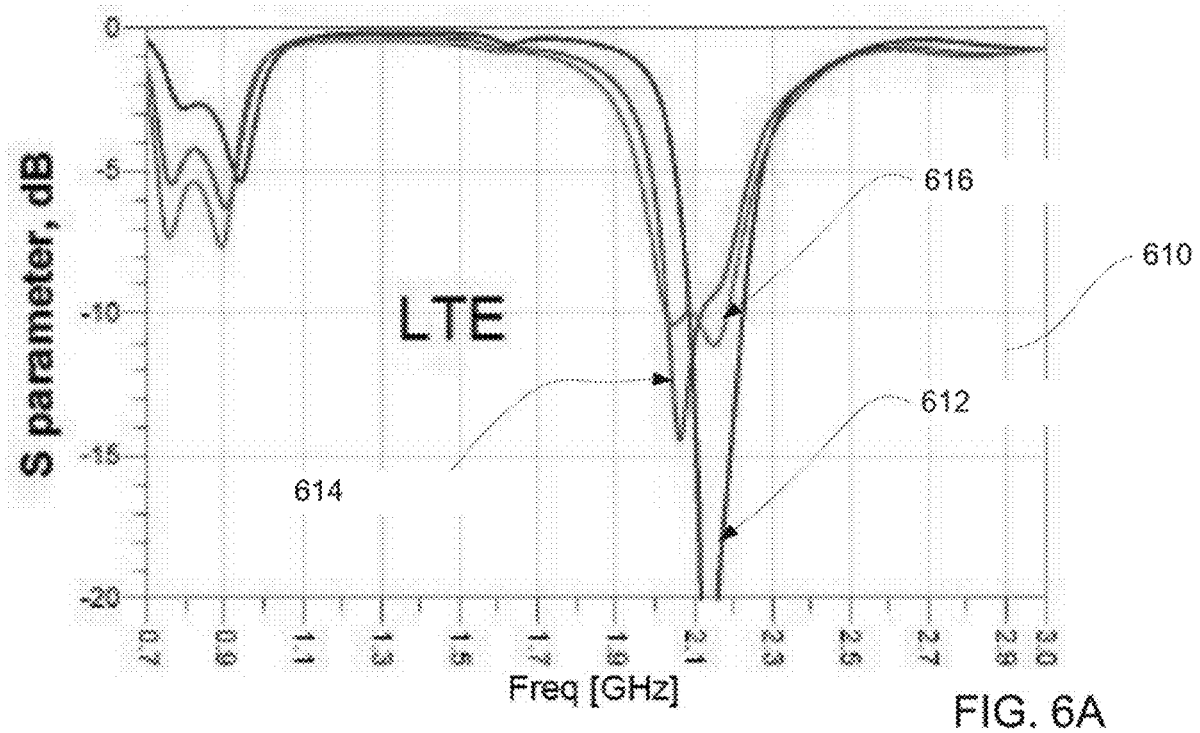
FIGS. 6A-6E are graphs showing example performance in response to body effects for example devices in accordance with aspects of the disclosure.

FIG. 6A shows graph 610, which are plots of the s parameter (S11) for the antenna 100C for the entire LTE frequency range between 700 MHz to 2700 MHz. Curve 612 shows the s parameter of the antenna 100C when the wearable device 500 is in free space (not being worn), curve 614 shows the s parameter of the antenna 100C when the wearable device 500 is worn loosely on the skin, curve 616 shows the s parameter of the antenna 100C when the wearable device 500 is worn tightly on the skin. Thus, these curves show that the s parameter of the antenna 100C is affected very slightly by the proximity of the skin (the troughs remain around the same resonant frequencies), which means that the detuning effect by the skin is very low.

Figure 6B:
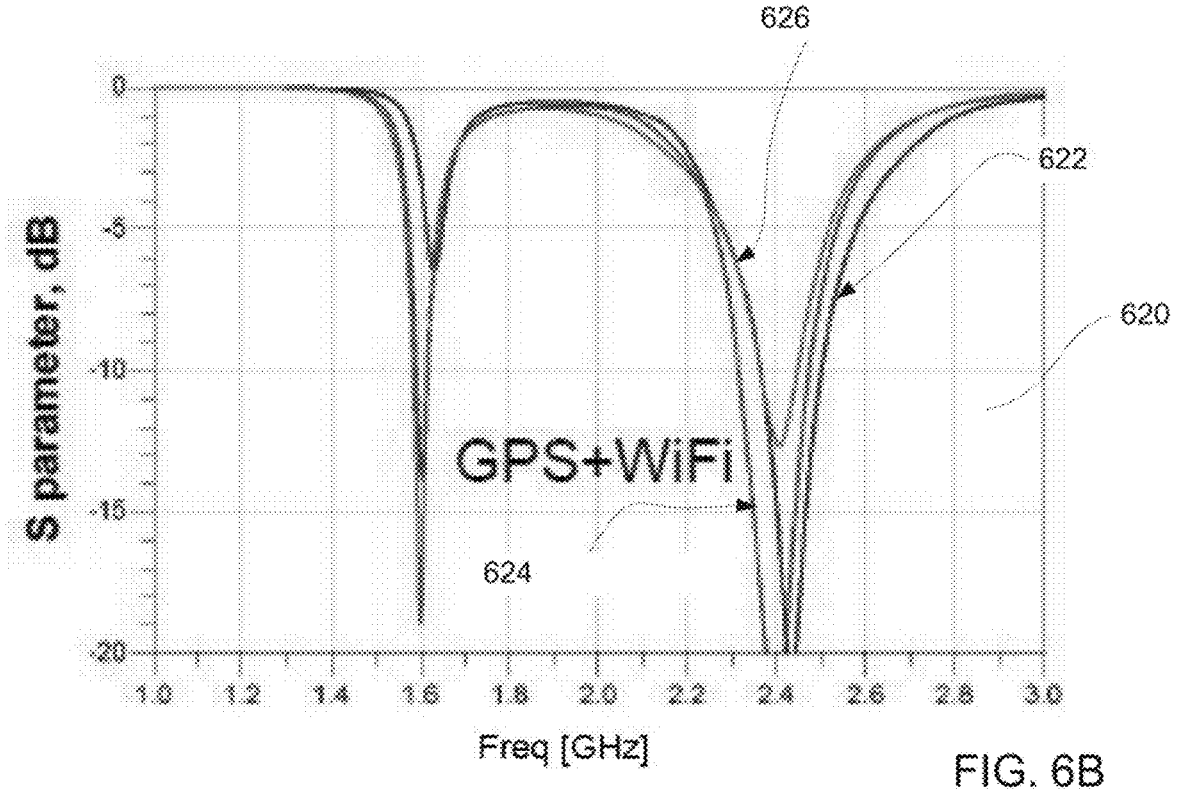

FIG. 6B shows graph 620, which are plots of the s parameter (S11) for the second antenna 310 for the entire LTE frequency range between 700 MHz to 2700 MHz. Curve 622 shows the s parameter of the second antenna 310 when the wearable device 500 is in free space (not being worn), curve 624 shows the s parameter of the second antenna 310 when the wearable device 500 is worn loosely on the skin, curve 626 shows the s parameter of the second antenna 310 when the wearable device 500 is worn tightly on the skin. Thus, these curves show that the s parameter of the second antenna 310 is also affected very slightly by the proximity of the skin (the troughs remain around the same resonant frequencies), which means the detuning effect by the skin is also very low.

Figure 6D:
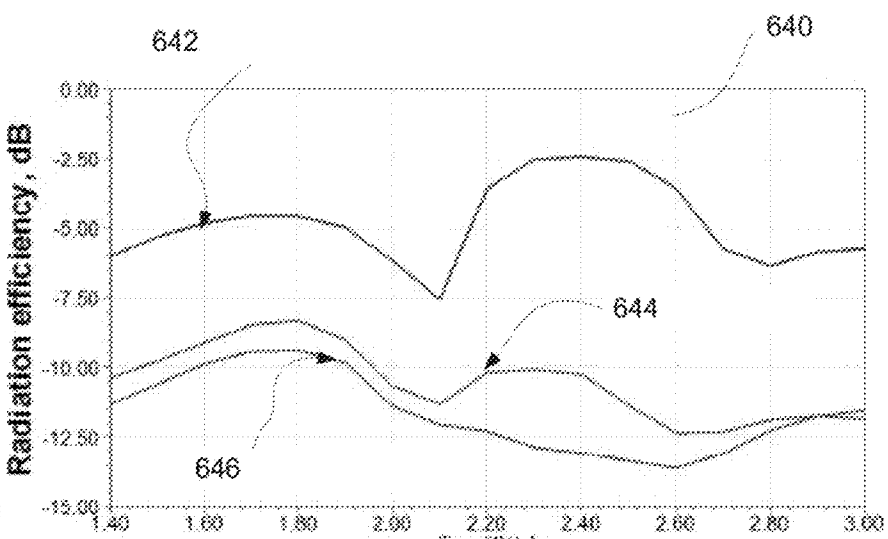
Figure 6C:
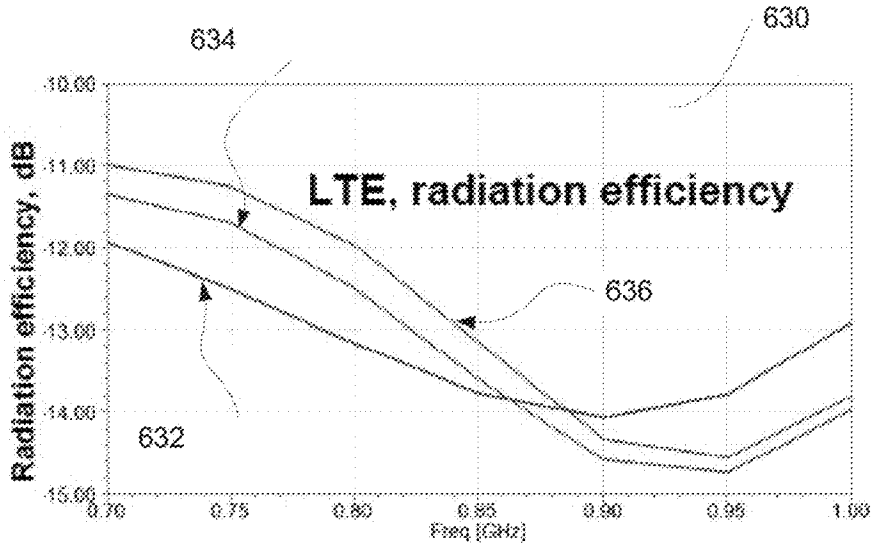

FIGS. 6C and 6D shows graphs 630 and 640, which are plots of the radiation efficiency for the antenna 100C for most of the LTE frequency range between 700 MHz to 2700 MHz. Curves 632 and 642 show the radiation efficiency of the antenna 100C when the wearable device 500 is in free space (not being worn), curve 634 and 644 show the radiation efficiency of the antenna 100C when the wearable device 500 is worn loosely on the skin, and curves 636 and 646 show the radiation efficiency of the antenna 100C when the wearable device 500 is worn tightly on the skin. Thus, these curves show that the radiation efficiency of the antenna 100C is affected slightly by the proximity of the skin, which means that the attenuation effect by the skin is very low.

Figure 6E:
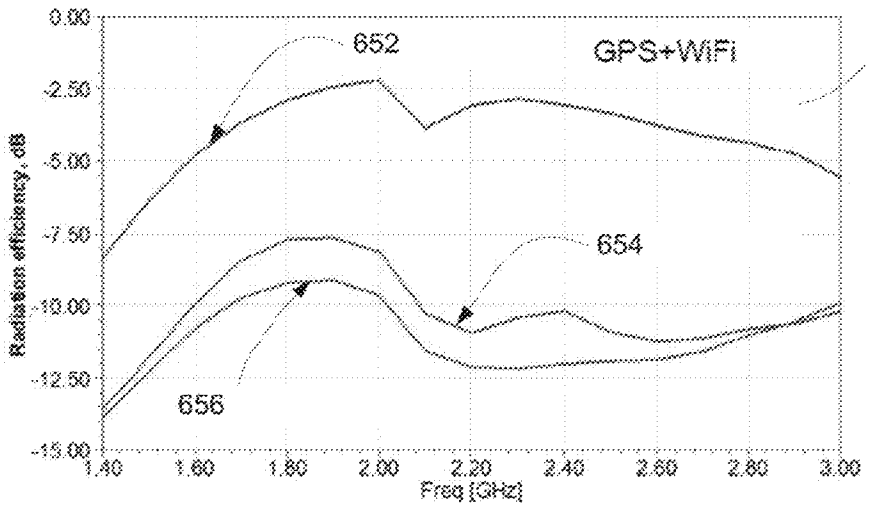

FIG. 6E shows graph 650, which are plots of the radiation efficiency for the second antenna 310 for the GPS (around 1575.42 MHz) and WiFi (2400 MHz to 2484 MHz) frequency ranges. Curve 652 shows the radiation efficiency of the second antenna 310 when the wearable device 500 is in free space (not being worn), curve 654 shows the radiation efficiency of the second antenna 310 when the wearable device 500 is worn loosely on the skin, and curve 656 shows the radiation efficiency of the second antenna 310 when the wearable device 500 is worn tightly on the skin. Thus, these curves show that the radiation efficiency of the second antenna is also affected slightly by the proximity of the skin, which means that the attenuation effect is very low.

FIG. 7 shows an example system 700 in accordance with aspects of the disclosure. The example system 700 may be included as part of the example wearable device 500. The system 700 has one or more computing devices, such as computing device 710 containing one or more processors 712, memory 714 and other components typically present in a smartphone or other personal computing device. For example, the computing device 710 may be incorporated on the circuit board 550 of the wearable device 500 shown in FIGS. 5B and 5C. The one or more processors 712 may be processors such as commercially available CPUs. Alternatively, the one or more processors may be a dedicated device such as an ASIC, a single or multi-core controller, or other hardware-based processor.

The memory 714 stores information accessible by the one or more processors 712, including instructions 716 and data 718 that may be executed or otherwise used by each processor 712. The memory 714 may be, e.g., a solid state memory or other type of non-transitory memory capable of storing information accessible by the processor(s), including write-capable and/or read-only memories.

The instructions 716 may be any set of instructions to be executed directly (such as machine code) or indirectly (such as scripts) by the processor. For example, the instructions may be stored as computing device code on the computing device-readable medium. In that regard, the terms "instructions" and "programs" may be used interchangeably herein. The instructions may be stored in object code format for direct processing by the processor, or in any other computing device language including scripts or collections of independent source code modules that are interpreted on demand or compiled in advance. Functions, methods and routines of the instructions are explained in detail below.

User interface 720 includes various I/O elements. For instance, one or more user inputs 722 such as mechanical actuators 724, soft actuators 726, and microphone 524 are provided. For example, as shown in FIG. 5C, the microphone 524 is attached to the housing 520. The mechanical actuators 724 may include a crown, buttons, switches and other components. The soft actuators 726 may be incorporated into a touchscreen cover, e.g., a resistive or capacitive touch screen, such as in the front cover 510 shown in FIGS. 5A-5B.

The user interface 720 may include various output devices. A user display 728, for example, a screen or a touch screen, is provided in the user interface 720 for displaying information to the user. For example, the user display 728 may be incorporated into the front cover 510 as shown in FIG. 5A-5B. The user interface 720 may also include one or more speakers, transducers or other audio outputs 730. For example, the audio output 730 may include the speaker 523 attached to the housing 520, as shown in FIG. 5C. A haptic interface or other tactile feedback 740 is used to provide non-visual and non-audible information to the wearer. For example, the haptic interface 740 may be implemented with the haptic motor 521 inside the housing 520 as shown in FIGS. 5B and 5C. The user interface 720 also includes one or more cameras 742, for example the cameras 742 can be included on the housing 520, a wristband, or incorporated into the display 728.

The user interface 720 may include additional components as well. By way of example, one or more sensors 525 may be located on or within the housing 520. For example, as shown in FIG. 5C, the sensors 525 are attached onto the housing 520. The sensors 525 may include an accelerometer, e.g., a 3-axis accelerometer, a gyroscope, a magnetometer, a barometric pressure sensor, an ambient temperature sensor, a skin temperature sensor, a heart rate monitor, an oximetry sensor to measure blood oxygen levels, and a galvanic skin response sensor to determine exertion levels. Additional or different sensors may also be employed.

The system 700 also includes a position determination module 744, which may include a GPS chipset 746 or other positioning system components. Information from the sensors 525 and/or from data received or determined from remote devices (e.g., wireless base stations or wireless access points), can be employed by the position determination module 744 to calculate or otherwise estimate the physical location of the system 700.

In order to obtain information from and send information to remote devices, the system 700 may include a communication subsystem 750 having a wireless network connection module 752, a wireless ad hoc connection module 754, and/or a wired connection module 756. The communication subsystem 750 includes the antenna control circuit 758. For example, the antenna control circuit 758 controls the feeding of the antennas 100C and 310, and the impedance tuner 160 and the aperture tuner 170 of the antenna system 300. While not shown, the communication subsystem 750 has a baseband section for processing data, a transceiver section for transmitting data to and receiving data from the remote devices. The transceiver may operate at RF frequencies via one or more antennae, such as the antennas 100C and 310 of the antenna system 300.

The wireless network connection module 752 may be configured to support communication via cellular, LTE, 4G, WiFi, GPS, and other networked architectures. The wireless ad hoc connection module 754 may be configured to support Bluetooth®, Bluetooth LE, near field communications, and other non-networked wireless arrangements. And the wired connection 756 may include a USB, micro USB, USB type C or other connector, for example to receive data and/or power from a laptop, tablet, smartphone or other device.

The system 700 includes one or more internal clocks 760 providing timing information, which can be used for time measurement for apps and other programs run by the smartwatch, and basic operations by the computing device(s) 710, GPS 746 and communication subsystem 750.

The system 700 includes one or more power source(s) 770 providing power to the various components of the system. The power source(s) 770 may include a battery, such as battery 522, winding mechanism, solar cell or combination thereof. For example, as shown in FIGS. 5B and 5C, the battery 522 is included inside the housing 520. The computing devices may be operatively couples to the other subsystems and components via a wired bus or other link, including wireless links.

The antenna and antenna system as described above provide for efficient operation of devices, particularly for small factor wearable electronic devices with high permittivity housings. Features of the antenna provide for forming composite tuning states having wider bandwidths by coupling the tuning states of two radiating elements. The wider bandwidths provide a multitude of practical advantages. For instance, higher antenna bandwidth increases throughput, improves link budget (gains and losses from a transmitter to receiver), and increase battery life as less power is needed for the antenna. For another instance, many commercial carriers set requirements for devices that are allowed to use their network, such as Total Radiated Power (TRP) and Total Isotropic Sensitivity (TIS). Insufficient antenna bandwidth may cause the devices to fail these requirements, and consequently not be able to use these commercial networks. Features of the antenna also provide for reduced interference from other components in the wearable electronic device, reduced coupling with other antennas, and greater isolation from the body effects of the user.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. An antenna for a personal computing device, the antenna comprising:

a first radiating element configured to be tuned to a first set of tuning states operating around a first set of resonant frequencies; and a second radiating element capacitively coupled to the first radiating element by a loading capacitor connecting the first and second radiating elements, the second radiating element configured to be tuned to a second set of tuning states operating around a second set of resonant frequencies, wherein the loading capacitor is plated directly on one or more inside surfaces of a housing of the personal computing device.

2. The antenna of claim 1, further comprising:

an impedance tuner positioned at a feed of the antenna, the impedance tuner configured to tune the first radiating element.

3. The antenna of claim 1, further comprising:

an aperture tuner connecting the second radiating element to a ground plane, the aperture tuner configured to tune the second radiating element.

4. The antenna of claim 3, wherein the aperture tuner is a loading inductor.

5. The antenna of claim 1, wherein the antenna further comprises:

a third radiating element coupled to the first radiating element, the third radiating element configured to be tunable to a third set of tuning states operating around a third set of resonant frequencies.

6. The antenna of claim 1, wherein a clearance between the antenna and a ground plane is within a threshold of 1 mm.

7. The antenna of claim 1, wherein one or more resonant frequencies from the first set of resonant frequencies and one or more resonant frequencies from the second set of resonant frequencies are in frequency ranges between 700 MHz and 960 MHz for LTE signals.

8. The antenna of claim 5, wherein one or more resonant frequencies from a third set of resonant frequencies are in frequency ranges between 1710 MHz and 2200 MHz for LTE signals.

9. The antenna of claim 1, wherein one or more harmonics of the resonant frequencies from the first set of resonant frequencies or one or more harmonics of the resonant frequencies from the second set of resonant frequencies are in at least one of frequency ranges between 1710 MHz and 2200 MHz for LTE signals or frequency ranges between 2500 MHz and 2700 MHz for LTE signals.

10. The antenna of claim 1, wherein the first radiating element and the second radiating element are conductive material plated on a dielectric material.

11. A personal computing device, comprising:

a housing, the housing made of a dielectric material;

a first antenna, the first antenna comprising:

a first radiating element configured to be tuned to a first set of tuning states operating around a first set of resonant frequencies; and a second radiating element capacitively coupled to the first radiating element by a loading capacitor connecting the first and second radiating elements, the second radiating element configured to be tuned to a second set of tuning states operating around a second set of resonant frequencies;

wherein the first radiating element and the second radiating element include conductive material plated on one or more inside surfaces of the housing, and wherein the loading capacitor is plated directly on the one or more inside surfaces of the housing.

12. The device of claim 11, further comprising:

a second antenna, the second antenna comprising:

a fourth radiating element configured to be tunable to a fourth set of tuning states operating around a fourth set of resonant frequencies, wherein one or more resonant frequencies from the fourth set of resonant frequencies are in frequency ranges centered at 1575.42 MHz for GPS signals, or between 2400 MHz and 2484 MHz for WiFi signals;

wherein the fourth radiating element include a conductive material plated on the one or more inside surfaces of the housing.

13. The device of claim 11, wherein the first antenna further comprises:

an impedance tuner positioned at a feed of the first antenna configured to tune the first radiating element;

wherein the impedance tuner is plated on the one or more inside surfaces of the housing.

14. The device of claim 11, wherein the first antenna further comprises:

an aperture tuner connecting the second radiating element to a ground plane;

wherein the aperture tuner is plated on the one or more inside surfaces of the housing.

15. The device of claim 11, wherein the first antenna further comprises:

a third radiating element coupled to the first radiating element, the third radiating element configured to be tunable to a third set of tuning states operating around a third set of resonant frequencies;

wherein the third radiating element include a conductive material plated on the one or more inside surfaces of the housing.

16. The device of claim 11, wherein a clearance between at least one of the first antenna or the second antenna and a ground plane is within a threshold of 1 mm.

17. The device of claim 11, wherein the device is a wearable personal computing device.

18. The device of claim 11, wherein the dielectric material is a glass or a ceramic material.

19. The antenna of claim 1, wherein the antenna is configured to be tuned such that a tuning state from the first set of tuning states of the first radiating element can be combined with a tuning state from the second set of tuning states of the second radiating element to form a composite tuning state of the antenna.

20. The device of claim 11, wherein the first antenna is configured to be tuned such that a tuning state from the first set of tuning states of the first radiating element can be combined with a tuning state from the second set of tuning states of the second radiating element to form a composite tuning state of the first antenna.

* * * * *